US007369797B2

(12) United States Patent
Yoshida et al.

(10) Patent No.: US 7,369,797 B2
(45) Date of Patent: May 6, 2008

(54) DEVELOPING APPARATUS AND PROCESS CARTRIDGE WITH PROTRUSIONS BETWEEN THE BEARING AND THE SHAFT

(75) Inventors: Hideyuki Yoshida, Jiangsu (CN); Yasuaki Tomoda, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 174 days.

(21) Appl. No.: 11/327,703

(22) Filed: Jan. 6, 2006

(65) Prior Publication Data

US 2006/0204282 A1 Sep. 14, 2006

(30) Foreign Application Priority Data

Mar. 10, 2005 (JP) ..... 2005-066852

(51) Int. Cl.
*G03G 15/08* (2006.01)
*G03G 21/00* (2006.01)

(52) U.S. Cl. ..... 399/256; 399/98; 399/119

(58) Field of Classification Search ..... 399/254, 399/256, 258, 102, 103, 119, 98; 430/110.4; 384/295, 418, 275, 276, 296, 428
See application file for complete search history.

(56) References Cited

U.S. PATENT DOCUMENTS 5,170,212 A * 12/1992 DeCecca ..... 399/103
5,283,621 A * 2/1994 Hashizume ..... 384/276 X
5,541,710 A * 7/1996 Stewart et al. ..... 399/98
5,845,182 A * 12/1998 Johroku et al. ..... 399/256
6,131,007 A * 10/2000 Yamaguchi et al. ..... 399/256
6,226,489 B1 * 5/2001 Eelen et al. ..... 399/327
6,780,558 B2 * 8/2004 Yamada et al. ..... 430/110.4 X
2004/0190929 A1 * 9/2004 Yoshiki ..... 399/103

FOREIGN PATENT DOCUMENTS

JP 02-254475 A * 10/1990
JP 05-297721 11/1993
JP 10-198163 7/1998
JP 11-133712 5/1999
JP 2000-035710 2/2000
JP 2000-088108 3/2000
JP 2000-098717 4/2000
JP 2000-214629 8/2000
JP 2000-229334 8/2000
JP 2000-320684 A * 11/2000
JP 2001-215765 A * 8/2001

* cited by examiner

*Primary Examiner*—Sophia S. Chen
(74) *Attorney, Agent, or Firm*—Lucas & Mercanti, LLP

(57) ABSTRACT

A developing apparatus includes a developer container for storing a developer which contains toner, a rotary member for stirring and conveying the developer, and a bearing member to hold the rotary member in the developer container. At least one of the bearing member and the rotary member has a plurality of protrusions on a portion of the bearing member which holds the rotary member, or on a portion of the rotary member which is held by the bearing member.

21 Claims, 6 Drawing Sheets

DEVELOPING APPARATUS AND PROCESS CARTRIDGE WITH PROTRUSIONS BETWEEN THE BEARING AND THE SHAFT

BACKGROUND OF THE INVENTION

The invention relates to a developing apparatus for turning an electrostatic latent image on an image retainer into a visible toner image, more particularly to a developing apparatus which reduces the generation of deposition or fusion-bonding of toner particles on bearing sections of rotary members such as a developing roller and a stirring and conveying screw, and a process cartridge which is equipped with the developing apparatus.

An electrophotographic image-forming apparatus forms an image by charging the surface of an image retainer uniformly by a charger and running an exposure unit according to a document or image data to form a latent image on an image retainer. Then, the image forming apparatus feeds a single-component developer which contains a toner only or a two-component developer which contains both toner and carrier to a developing zone by turning the latent image into a toner image on the image retainer by a contact or non-contact developing manner, causes a transfer unit to transfer the toner image onto a transfer material such as a paper sheet, and thermally fix the toner image on the transfer material on the transfer material.

The developing apparatus for developing a latent image into a toner on the image retainer is equipped, for example, with a developing sleeve made of a cylindrical member which can rotate, stationary magnets provided in the developing sleeve, and a stirring member which stirs the two-component developer and applies electric charges adequate for development. The developing apparatus causes the developing sleeve to retain the charged two-component developer which is attracted by the magnet on the circumferential surface of the sleeve and feed the developer from the surface of the developing sleeve sequentially to the developing zone while the developing sleeve rotates to make the latent image visible on the image retainer. After development, the developer left on the developing sleeve is automatically removed from the developing sleeve by repulsive actions of magnetic fields generated by arrangement of magnet poles of the built-in magnets.

Various rotary members such as the developing sleeve in the developing apparatus are rotated to carry a developer and supply the developer to the developing sleeve. These rotary members are rotatably supported by bearing sections in the developing apparatus.

FIG. 13 shows a partial sectional view of a sample structure of a bearing section in a conventional developing apparatus.

Referring to FIG. 13, numeral 46 is a developer container which contains a developer and holds various rotary members such as a developing sleeve. Numeral 461 is a bearing section fixed to the side wall of developer container 46. Numeral 432 is an axis of a rotary member whose end is fitted with shaft section 433 in a body. The shaft section 433 has a large-diameter part F and a small-diameter part E. The small-diameter part E is rotatably fit into hole H of bearing section 461 which is fixed to the side wall. The axial-movement of the rotary member-is limited by the further end face of bearing section 461 (which is away from the side wall of developer container 46) and the end face of the large-diameter part F opposite to the end face of bearing section 461. In other words, the axial movement of the rotary member is limited by the sliding surface which is the whole end face of bearing section 461.

By the way, when the developer enters the bearing section which holds the rotary member in the developing apparatus, the developer may be broken by sliding inside the bearing section. In the example of FIG. 13, the sliding surface is the whole end face of bearing section 461 and may break the developer easily.

To solve this problem, various measures have been taken to prevent the developer from entering the sliding surface. Substantially, conventional technologies have employed sealing members or filling materials to shut out developer from the clearance of the bearing section (i.e. see Patent Document 1), structures which do not allow developer to go into the bearing section together with a sealing member (i.e. see Patent Document 2), and technology to prevent invasion of the developer into the bearing section by using distribution of magnetic flux density of the developing sleeve (i.e. see Patent Document 3). As just described above, the conventional technologies have improved developing apparatus, based on the concept to prevent developer from entering the bearing sections.

However, it is very difficult to completely prevent invasion of fine toner particles in microns. As the period of image formation service becomes longer, toner particles have deposited in the bearing sections little by little. Further, recently, as the digital electro-photographic technology has advanced, high-quality toner images have been demanded. On this demand, technologies to produce chemical toners as typified by polymerization toners have become conspicuous. Thanks to these technologies, we can produce small toner particles of some microns in diameter. Further, on environmental concerns, image forming apparatus are requested to save energy and at the same time image forming technologies to fix images at low temperature have been demanded. One of such technologies has provided toners whose softening point is much lower than the softening points of conventional toners. (For example, see Patent Document 4.)

However, no technology has been established to completely prevent toner particles from entering bearing sections of rotary members in developing apparatus. Furthermore, the above fine toner particles of some microns in diameter have made the invasion problem more actualized. Particularly, small-diameter toners for low-temperature fixing can easily invade the bearing sections and are easily coagulate and fusion-bonded by little frictional heat.

Recent image forming apparatus have been demanded to be smaller and faster. Therefore, parts are densely arranged near the developing unit. This reduces the efficiency of heat radiation and makes the invasion and fusion-bonding problems more serious. Further, to meet the increasing demand for color printouts at offices, various kinds of color image forming apparatus have been developed vigorously. However, the color image forming apparatus must be equipped with plural developing units, which makes the components arranged densely around the developing units. Consequently, it has been earnestly demanded to solve the problems of toner coagulation and fusion-bonding in the developing units.

[Patent Document 1] Japanese Non-Examined Patent Publication H10-198163

[Patent Document 2] Japanese Non-Examined Patent Publication 2000-88108

[Patent Document 3] Japanese Non-Examined Patent Publication H05-297721

[Patent Document 4] Japanese Non-Examined Patent Publication 2000-214629

The above problems are caused by invasion of toner particles into the trapped sliding space between the rotary member shaft and the bearing section and grinding of toner particles by the sliding surfaces. The present inventors inferred that coagulation and fusion-bonding of toner particles are accelerated because the sliding space in the bearing section is densely filled up with toner particles and that the inventors can possibly solve the problem by reducing the sliding surfaces which grind the invading toner particles even when the toner particles are for low-temperature fixing. After a long trial-and-error process, we have reached the invention. In other words, unlike the concept of the conventional technologies which prevents invasion of toner particles into bearing sections, the invention uses a concept of suppressing coagulation and fusion-bonding of toner particles by reducing the sliding surfaces between the rotary member shaft and the bearing section since fine toner particles invade the sliding surfaces through the clearance of the bearing section and are ground there.

SUMMARY OF THE INVENTION

In view of the above description, an object of the present invention is to provide a developing apparatus which can reduce the generation of being ground of toner particles in the sliding portion between the shaft section of the rotary member and the bearing section, and coagulation or fusion-bonding of the toner particles which enter the bearing sections holding rotary members in the developing apparatus. Particularly, an object of the invention is to provide a developing apparatus capable of preventing the quality of toner particles from being deteriorated even when the toners are small-diameter toners which excels in reproduction of thin lines to meet the demand of the recent digital image forming technology or toners of low fixing temperature for energy saving.

An aspect of the invention provides: a developing apparatus comprising a developer container for storing a developer which contains toner, a rotary member for stirring and conveying the developer, and bearing member to hold the rotary member in the developer container, wherein the bearing member is equipped with protrusions on the area which holds the rotary member.

An another aspect of the invention provides: a developing apparatus comprising a developer container for storing a developer which contains toner, a rotary member for stirring and conveying the developer, and bearing member to hold the rotary member in the developer container, wherein the rotary member is equipped with protrusions on the area on which the rotary member is supported by the bearing member.

A still another aspect of the invention provides: a process cartridge equipped with a developing apparatus comprising a member used for image formation, a developer container to store a developer which contains toner, a rotary member for stirring and conveying the developer, and a bearing member to hold the rotary member in the developer container, wherein the bearing member has protrusions on the area which holds the rotary member.

A still another aspect of the invention provides: a process cartridge equipped with a developing apparatus comprising a member used for image formation, a developer container to store a developer which contains toner, a rotary member for stirring and conveying the developer, and a bearing member to hold the rotary member in the developer container, wherein the rotary member has protrusions on the area on which the rotary member is held by the bearing member.

DETAILED DESCRIPTION OF THE PREFERRED EMBODIMENT (Technical Concept of the Invention)

The invention relates to a developing apparatus which is used in an electro-photographic image forming apparatus such as a copier and a printer.

The present inventors focused attention on behaviors of toner particles in bearing sections which hold rotary members such as a developing sleeve and stirring and conveying screws which are components of the developing apparatus. The inventors ascertained that toner particles are held blind in the bearing sections, taken into the sliding space formed between the shaft section of a rotary member and the wall of each bearing section, ground and broken by the sliding surfaces, and/or coagulated or fusion-bonded. Judging from the above, the inventors inferred that the inventors can possibly solve the problem by reducing the sliding surfaces which are formed on the bearing section and the inventors have reached the invention.

(Embodiments of Image Forming Apparatus)

The details of examples of the invention will be described below in reference with the accompanying drawings, but the embodiments of the invention are not intended as a definition of the limits of the invention.

Figure 1:
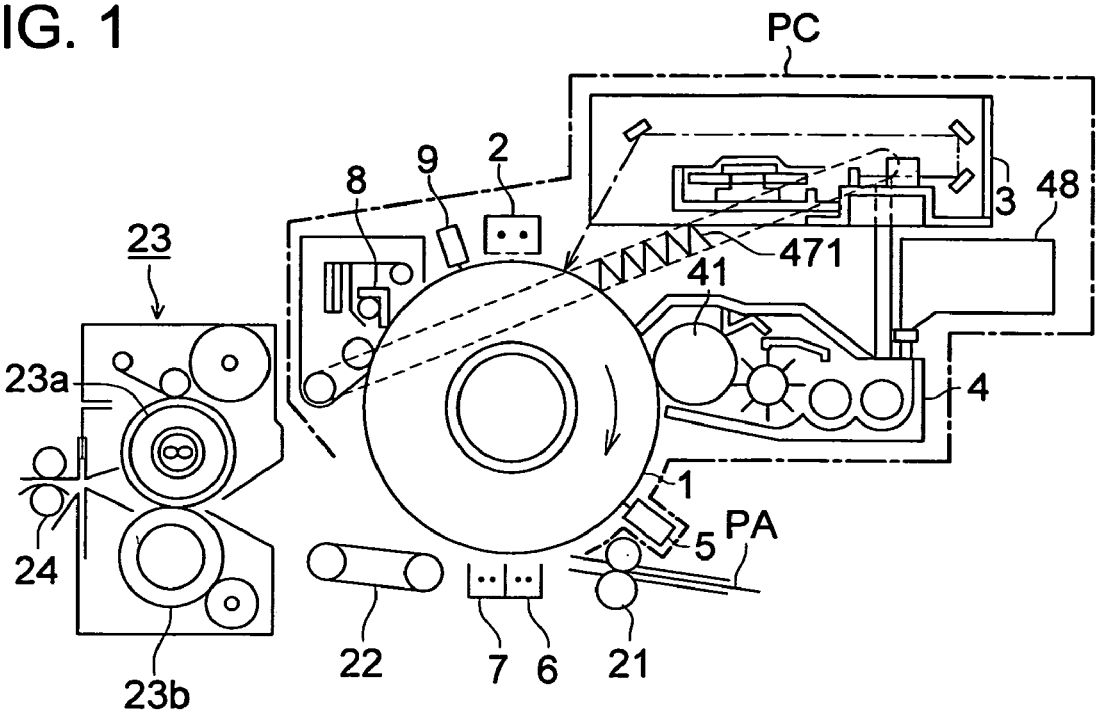
FIG. 1 is a sectional view of an image forming apparatus equipped with a developing apparatus which is an embodiment of the invention and an image forming section of a process cartridge.

FIG. 1 is a sectional diagram of an image forming apparatus equipped with a developing apparatus (using a two-component developer), which is an embodiment of the invention and a process cartridge.

Numeral 1 is a cylindrical image retainer (also called a photoreceptor drum) which is produced by coating a grounded metallic cylinder substrate with a dispersion liquid which disperses a phthalocyanine pigment in polycarbonate to form an negatively-charged organic semiconductor layer as a photoreceptor layer including a charge-carrying layer. The drum is driven to rotate in the arrow direction.

Numeral 2 is a scorotron charger which gives electric charges of a preset polarity and a preset potential to the surface of Photoreceptor Drum 1. With this, the surface of Photoreceptor Drum 1 is charged uniformly.

Numeral 3 is an imagewise exposure unit of a laser scanning method which uses a semiconductor laser diode (LD) as a light emitting element. Imagewise exposure unit 3 scans the evenly-charged drum surface with a laser beam to form an electric latent image.

Developing apparatus 4 develops an electrostatic latent image on photoreceptor drum 1 into a visible toner image by developing sleeve 41 which rotates facing to photoreceptor drum 1. The development is carried out using a two-component developer in combination of image exposure and reversal development in a contact or non-contact manner. Developing sleeve 41 is produced by spraying molten stainless steel to the outer surface of a magnet roller and coating the surface-treated magnet roller with an aluminum sleeve. A developing bias of a direct-current component is applied to developing sleeve 41 for reversal development.

Numeral 48 is a toner hopper to replenish new toner to developing apparatus 4.

A two-component developer containing non-magnetic toner and magnetic carrier is polymerization toner whose number median diameter is preferably 3 to 8 μm and more preferably 4.5 to 7 μm. By using the polymerization toner, the image forming apparatus can form high-resolution fogless images whose density is stable.

Preferable carriers are ferrite-core carriers made of magnetic particles having a number median diameter of 30 to 65 μm.

Numeral 5 is a light-emitting diode unit LED which works as a pre-transfer exposure light source to increase the transferability of a toner image. LED 5 illuminates the surface of photoreceptor drum 1.

Numeral 6 is a transferring electrode of the corotron and mainly made of a wire and a backplate. This electrode transfers a toner image from photoreceptor drum 1 to a transfer paper sheet by a transfer current which is controlled to be constant.

Numeral 7 is a separation electrode of the corotron and mainly made of a wire and a backplate. This electrode promotes separation of a transfer paper sheet from photoreceptor drum 1 by a separation current which contains AC and DC components.

Transfer paper PA coming from a paper feeding section is fed by registration roller 21 in synchronism with a toner image which is formed on photoreceptor drum 1, receives the toner image by the transferring electrode 6 in the transfer nip section, carried through the transfer nip section, separated from the surface of photoreceptor drum 1 by separation electrode 7, and then carried to fixing unit 23 by conveyor belt 22.

Fixing unit 23 is equipped with heating roller 23*a* which houses a heater and pressure roller 23*b*. Transfer paper sheet PA having a toner image on it is heated and pressed between the heat roller 23*a* and pressure roller 23*b* to fix the image and ejected to an outside ejection tray (not shown in the drawings) by ejection roller 24.

After transferring the toner image to paper PA, the surface of photoreceptor drum 1 is cleaned to remove residual un-transferred toner by cleaning device 8. This embodiment uses a urethane rubber blade as the cleaning unit. The cleaning blade is in sliding contact with the surface of photoreceptor drum 1 to clean off residual toner. After being cleaned by cleaning device 8, the surface of photoreceptor drum 1 is illuminated by pre-charge exposure unit (PCL) 9 to reduce the residual potential and then ready for the next image formation cycle.

The toner removed by cleaning device 8 is recollected into developing apparatus 4 by circulation conveyor 471 which uses a conveying screw or the like. This toner recollection into developing apparatus 4 is carried out in synchronism with the rotation of photoreceptor drum 1.

Next will be explained process cartridge PC which contains developing apparatus 4 in accordance with the invention.

As shown by a part enclosed with a dash-single-dot line in FIG. 1, process cartridge PC of this Embodiment is equipped with developing apparatus 4 and at least one of image forming members (photoreceptor drum 1, charger 2, etc.) which are assembled in a body so that process cartridge PC can be easily mounted on and demounted from the image forming apparatus. The image forming members are photoreceptor drum 1, charger 2, imagewise exposure unit 3, pre-transfer exposure light source 5, and pre-charge exposure unit 9.

Developing apparatus 4 is so built as to be mounted on and demounted from process cartridge PC.

(Embodiments of Developing Apparatus)

Next will be explained embodiments of the developing apparatus (using a two-component developer) in accordance with the invention.

Figure 2:
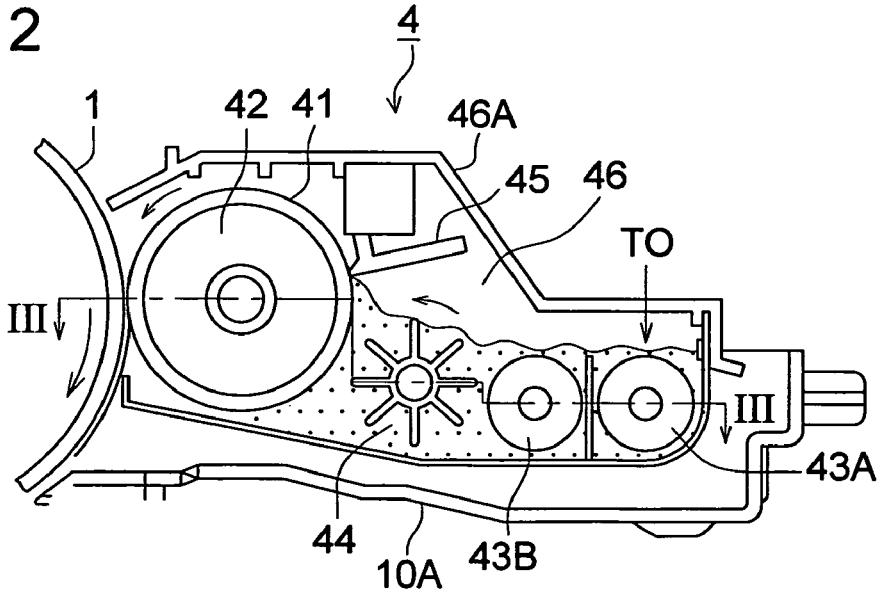
FIG. 2 is a major sectional view of an image forming apparatus equipped with a developing apparatus which is an embodiment of the invention.

FIG. 2 shows a major sectional view of an image forming apparatus in accordance with the invention.

In FIG. 2, developing apparatus 4 is preferably a so-called developing unit or developer cartridge which is easily mounted on and demounted from the image forming apparatus. In other words, developing apparatus 4 to be used as a developing unit contains components such as developing sleeve 41 and rotary paddle 44 to be explained later in well-closed developer container 46. Developer container 46 is pre-loaded with a preset quantity of developer TO. Here, developer container 46 works functionally as a developer container in the invention. The components such as developing sleeve 41 and rotary paddle 44 are equivalent to rotary members in the invention.

Developing apparatus 4 and photoreceptor drum 1 are mounted together on frame 10A of a drum cartridge. The drum cartridge is mounted in the body of the image forming apparatus for image formation and demounted from the apparatus for change of developer. Numeral 46A is a top cover which is united with developer container 46.

Developing apparatus 4 contains developing sleeve 41 which is one of rotary members in the invention and equipped with stationary magnet 42 for developing. Developing sleeve 41 is arranged to rotate in the arrow direction. In the developer, carriers are coated with toner particles by electric charges caused by mutual friction of particles. Consequently, the developer is attracted to the surface of developing sleeve 41 by magnetic forces of stationary magnet 42. The thickness of the developer layer on the surface of developing sleeve 41 is regulated by layer thickness regulator 45. The developer on the surface of developing sleeve 41 is carried to the developing zone opposite to Photoreceptor Drum 1 for developing.

Developer container 46 contains a pair of stirring and conveying screws 43A and 43B and rotary paddle 44 which are equivalent to rotary members of the invention and convey the developer towards developing sleeve 41 in the container while stirring the developer. Each of stirring and conveying screws 43A and 43B is a rod-like screw member. One of the screws 43A and 43B conveys the developer from the near-side of paper to the far-side of paper and the other screw conveys the developer from the far-side of paper to the near-side of paper. For each image formation, new toner is supplied from toner hopper 48 to developing apparatus 4. The supplied toner falls over the developer which is circulated by stirring and conveying screw 43A and 43B, mixed and stirred therewith, and sent towards rotary paddle 44. The toner and the developer which is being mixed and stirred are further stirred together by mill-wheel-shaped rotary paddle 44 and sent to developing sleeve 41.

Figure 3:
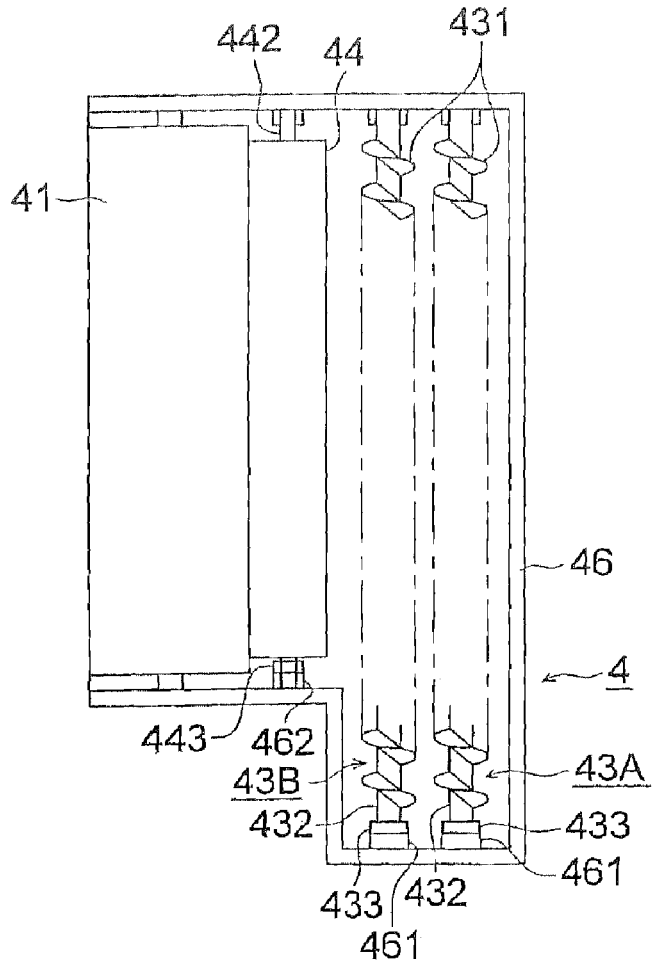
FIG. 3 is a sectional view taken on line III-III in FIG. 2.

FIG. 3 is a sectional view taken on line III-III in FIG. 2.

Developer container 46 contains developing sleeve 41, a pair of stirring and conveying screw 43A and 43B, and rotary paddle 44. Each of stirring and conveying screw 43A and 43B consists of blade section 431 and screw shaft 432 and is united with shaft sections 433. Developer container 46 contains bearing sections 461 which are equivalent to rotary member holders in the invention to hold shaft sections 433 rotatably. Similarly, rotary paddle 44 contains paddle shaft 442 whose ends are respectively united with shaft sections 443. Shaft sections 443 are rotatably supported by bearing section 462 equivalent to rotary member holders in the invention which are provided on the inner wall of developer container 46.

Figure 4:
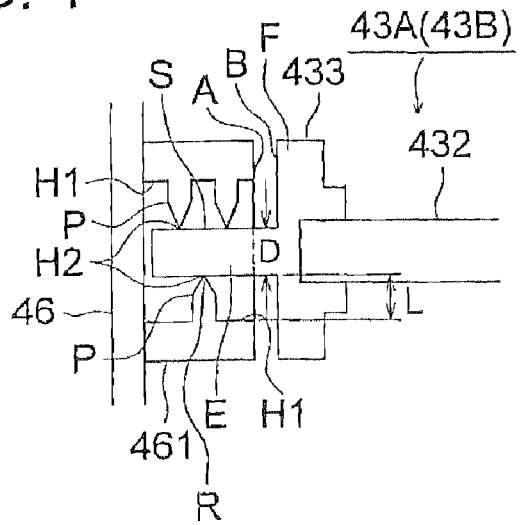
FIG. 4 is a fragmentary view to explain the structure and operation of the first embodiment of a bearing member in accordance with the invention.
Figure 5:
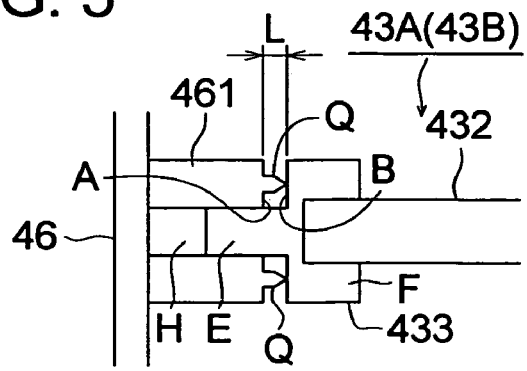
FIG. 5 is a fragmentary view to explain the structure and operation of the second embodiment of a bearing member in accordance with the invention.
Figure 6:
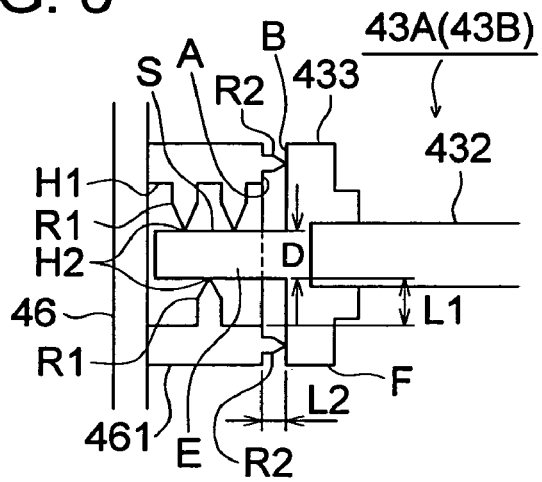
FIG. 6 is a fragmentary view to explain the structure and operation of the third embodiment of a bearing member in accordance with the invention.

FIG. 4 to FIG. 6 respectively shows a fragmentary sectional view to explain the structure and operation of the bearing sections in the developing apparatus in accordance with the invention. Protrusions shown in the drawings are preferably constituted such that each of the protrusions provided on one of a shaft section and a bearing section repeats alternately to come in contact with and in non-contact with a certain point on the circumferential surface of the other section during rotation, even if the bearing section and the section are observed from either a first direction of the axis of rotary member like FIGS. 4 to 10 or a second direction perpendicular to the first direction. By having a plurality of the protrusions and this constitution, the shaft section can be supported stably without trembling the shaft section unnecessarily, so that the clogging the toner particles or carrier particles in the bearing section. Also, by this constitution, wearing of the protrusions can be slowed.

In FIG. 4, screw shaft 432 of each stirring and conveying screw 43A and 43B is fit into shaft section 433 and united in a body. Shaft section 433 has large-diameter part F and small-diameter part E. The small-diameter part E is fit into hole H2 of bearing section 461 which is fixed on the inner wall of developer container 46 so as to rotate freely. Bearing section 461 fixed on the inner wall of developer container 46 has inner wall H1 inside the section 461. The inner wall H1 of bearing section 461 has plural protrusions P of L mm long each of which protrudes towards the center of bearing section 461 from inner wall H1. The further end of each protrusion is tapered to form a conical end and the tip of each protrusion is rounded to have a small radius R. The tips of the protrusions P are disposed to be on an identical cylindrical surface S which forms hole H2 whose diameter is equal to the inner diameter of bearing section 461. That is, the bearing section has the plural protrusions on a surface parallel to the axis of the rotary member. In other words, the small diameter part E of shaft section 433 is rotatably supported by hole H2 which is formed by small rounded tips of plural protrusions P. This means that shaft section 433 is supported by a very small area and rotates with less friction. Therefore, it becomes less possible that toner particles trapped in a space between shaft section 433 and bearing section 461 is grounded by the sliding surfaces formed between of the small diameter part E of shaft section 433 and hole H2 of bearing section 461.

Referring to FIG. 5, another embodiment of the bearing member will be explained below. In FIG. 5, screw shaft 432 of each stirring and conveying screw 43A and 43B is fit into shaft section 433 and united in a body. Shaft section 433 has large-diameter part F and small-diameter part E. The small-diameter part E is fit into hole H of bearing section 461 which is fixed on the inner wall of developer container 46 so as to rotate freely. One of end faces of bearing section 461 is fixed on the inner wall of developer container 46 and the other end face A has four protrusions Q (L mm long each) each of which extends along the central axis of hole H. The tip of each protrusion Q is tapered to be conical and the top of the tip is rounded (to a preset radius R). The tips of protrusions Q-are on a plane perpendicular to the central axis of hole H and in contact with the end face B of the large-diameter part F of shaft section 433 which faces bearing section 461. This mechanism limits the axial movement of each stirring and conveying screw 43A and 43B. While the pair of stirring and conveying screws 43A and 43B rotate, the large-diameter part F of shaft section 433 slides on the tips of protrusions Q. In other words, only the tips of four protrusions Q on the sliding surface to limit the axial movement of the screws are in contact with the end face B of the large-diameter part F of shaft section 433.

With the use of these protrusions Q, the sliding surface area becomes extremely reduced and it is assumed that toner particles will never be ground by the sliding surfaces between shaft section 433 and bearing section 461 even when the toner particles are trapped in the space therebetween.

Referring to FIG. 6, another embodiment of the bearing member will be explained below. In FIG. 6, screw shaft 432 of each stirring and conveying screw 43A and 43B is fit into shaft section 433 and united in a body. Shaft section 433 has large-diameter part F and small-diameter part E. The small-diameter part F is fit into hole H2 of bearing section 461 which is fixed on the inner wall of developer container 46 so as to rotate freely. One of the end faces of bearing section 461 is fixed to the inner wall of developer container 46. Inner wall H1 of bearing section 461 has plural protrusions R1 of L1 mm long each of which protrudes towards the center of bearing section 461 from inner wall H1. The further end of each protrusion R1 is tapered to form a conical end and the tip of each protrusion is rounded to have a small radius R. The tips of the protrusions R1 are disposed to be on an identical cylindrical surface S which forms hole H2 whose diameter is equal to the inner diameter of bearing section 461. That is, the bearing section has the plural protrusions on a surface parallel to the axis of the rotary member. In other words, the small diameter part E of shaft section 433 is fit to and rotatably supported by hole H2 which is formed by small rounded tips having a small radius R of plural protrusions R1. This means that shaft section 433 is supported by a very small contact area and rotates freely. Therefore, it becomes less possible that toner particles trapped in a space between shaft section 433 and bearing section 461 is grounded by the sliding surfaces formed between of the small diameter part E of shaft section 433 and hole H2 of bearing section 461.

The other end face A of bearing section 461 has four protrusions R2 (L2 mm long each) each of which extends along the central axis of hole H2. The tip of each protrusion R2 is tapered to be conical and the top of the tip is rounded (to a preset radius R) The tips of protrusions R2 are on a plane perpendicular to the central axis of hole H2 and in contact with the end face B of the large-diameter part F of shaft section 433 which faces bearing section 461. This mechanism limits the axial movement of each stirring and conveying screw 43A and 43B. While the pair of stirring and conveying screws 43A and 43B rotate, the large-diameter part F of shaft section 433 slides on the tips of protrusion R2. In other words, only the tips of four protrusions R2 on the sliding surface to limit the axial movement of the screws are in contact with the end face B of the large-diameter part F of shaft section 433. With the use of these protrusions R2, the sliding surface area becomes extremely reduced and it is assumed that toner particles will never be ground by the sliding surface between shaft section 433 and bearing section 461 even when the toner particles are trapped in the space therebetween.

FIG. 7 to FIG. 10 respectively show a fragmentary sectional view to explain the structure and operation of shaft and bearing sections of rotary members in the developing apparatus in accordance with the invention.

Figure 7:
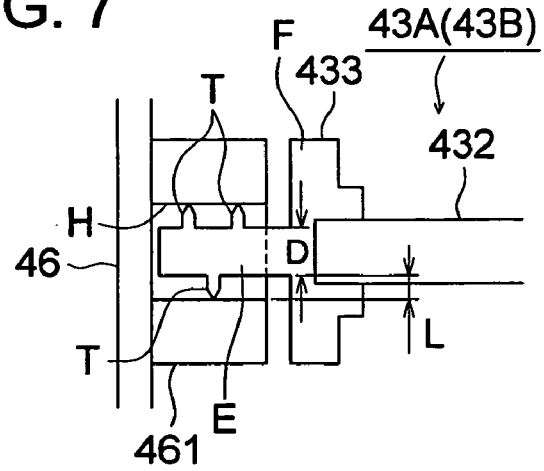
FIG. 7 is a fragmentary view to explain the structure and operation of the first embodiment of a rotary member in accordance with the invention.

In FIG. 7, screw shaft 432 of each stirring and conveying screw 43A and 43B is fit into shaft section 433 and united in a body. Shaft section 433 has large-diameter part F and small-diameter part F. The small diameter part E has plural protrusions T of L mm long radially protruded from the surface outwards. The further end of each protrusion is tapered to form a conical end and the tip of each protrusion is rounded to have a small radius R. The tips of the protrusions T are dispersed to be on an identical cylindrical surface. That is, the rotary member has the plural protrusions on a surface parallel to the axis of the rotary member. This cylindrical surface formed by the tips of the plural protrusions is assumed to be a rotary shaft of the stirring and conveying screws 43A and 43B. This cylindrical shaft with the plural protrusions is inserted into hole H of Bearing Section 461 which is fixed to the inner wall of developer container 46 and held so as to rotate the rotary shaft of the stirring and conveying screw 43A and 43B freely. In other words, since the shaft to be fit to the hole H of bearing section 461 has a cylindrical formed by tips of plural protrusions T, the sliding area in the hole H of bearing section 461 in contact with the tips of the protrusions of the screw shaft is extremely small. Therefore, it is assumed that toner particles will never be ground by the sliding surfaces between shaft section 433 and bearing section 461 even when the toner particles are trapped in the space therebetween.

Figure 8:
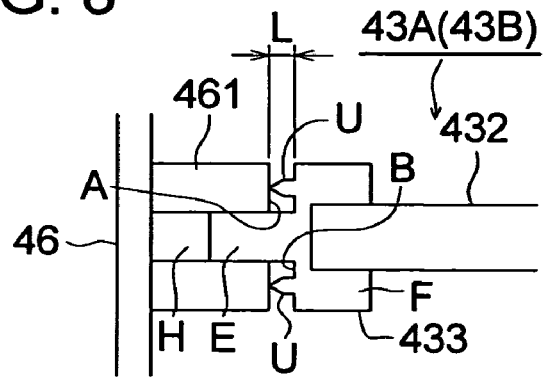
FIG. 8 is a fragmentary view to explain the structure and operation of the first embodiment of a rotary member in accordance with the invention.

Next will be explained another embodiment of the rotary member, referring to FIG. 8. In FIG. 8, screw shaft 432 which is one of stirring and conveying screws 43A and 43B in pair is capped with shaft section 433 in a body. Shaft section 433 has large-diameter part F and small-diameter part E. The small-diameter part E is fit into hole H of bearing section 461 which is fixed on the inner wall of developer container 46 so as to rotate freely. Bearing section 461 fixed on the inner wall of developer container 46 has hole H inside the section 461. The end face B of the large-diameter part F of shaft section 433 has four protrusions U of L mm long in parallel with the small diameter part H. The tip of each protrusion U is tapered to be conical and the top of the tip is rounded to a preset radius R. The tips of protrusions U are on a plane perpendicular to the central axis and in contact with the other end face A of bearing sections 461 to limit the axial movement of the stirring and conveying screw 43A and 43B. In other words, the axial movement of the stirring and conveying screw 43A and 43B is made on an extremely small contact area since this axial movement is limited by a surface-point contact between the end face A of bearing section 461 and tips of four protrusions U instead of a surface-surface contact between the end face A of bearing section 461 and the end face B of the large-diameter part F of shaft section 433. Therefore, it is assumed that toner particles will never be ground by the sliding surfaces between shaft section 433 and bearing section 461 even when the toner particles are trapped in the space therebetween.

Figure 9:
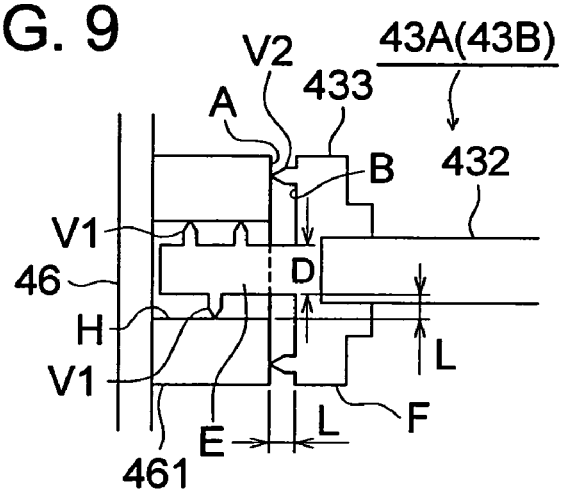
FIG. 9 is a fragmentary view to explain the structure and operation of the first embodiment of a rotary member in accordance with the invention.

Next will be explained another embodiment of the rotary member, referring to FIG. 9. In FIG. 9, screw shaft 432 which is one of stirring and conveying screws 43A and 43B in pair is capped with shaft section 433 in a body. Shaft section 433 has large-diameter part F and small-diameter part E. The small diameter part E has plural protrusions V1 of L mm long protruded outwards with their tips on a cylindrical surface. That is, the rotary member has the plural protrusions on a surface parallel to the axis of the rotary member. The small-diameter part E of shaft section 433 with the plural protrusions V1 (L mm long each) is inserted into hole H of bearing section 461 which is fixed to the inner wall of developer container 46. The hole H receives the cylindrical surface made with tips of plural protrusions V1 (L mm long each, protruded from the surface of the small diameter part E) and holds the stirring and conveying screw 43A and 43B to rotate freely. The tip of each protrusion V1 is tapered to be conical and the top of the tip is rounded to have a preset radius R. In other words, the shaft part to be fit to the hole H of bearing section 461 has a cylindrical surface made of tips of plural protrusions V1 and consequently the contact area is extremely small between the inner wall of the hole H of bearing section 461 and the cylindrical surface made by tips of plural protrusions V1. Therefore, it is assumed that toner particles will never be ground by the sliding surfaces between shaft section 433 and bearing section 461 even when the toner particles are trapped in the space therebetween.

Meanwhile, the end face B of the large-diameter part (F) of shaft section 433 has four protrusions V2 of L mm long in parallel with the small diameter part E. The tip of each protrusion V2 is tapered to he conical and the top of the tip is rounded to a preset radius R. The tips of protrusions V2 are on a plane perpendicular to the central axis and in contact with the other end face A ofbhearing section 461 to limit the axial movement of the stirring and conveying screw 43A and 43B. In other words, the axial movement of the stirring and conveying screw 43A and 43B is made on an extremely small contact area since this axial movement is limited by a surface-point contact between the end face A of bearing section 461 and tips of four protrusions V2 instead of a surface-surface contact between the end face A of bearing section 461 and the end face B of the large-diameter part F of shaft section 433. Therefore, it is assumed that toner particles will never be ground by the sliding surfaces between shaft section 433 and bearing section 461 even when the toner particles are trapped in the space therebetween.

Figure 10:
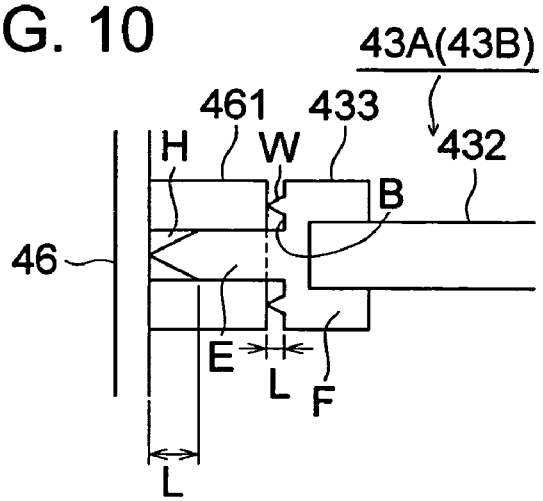
FIG. 10 is a fragmentary view to explain the structure and operation of the first embodiment of a rotary member in accordance with the invention.
Figure 13:
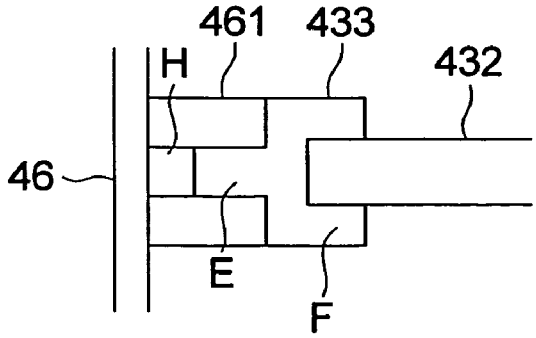
FIG. 13 PRIOR ART
FIG. 13 is a fragmentary view to explain the structure and operation of the shaft and bearing sections of rotary members in a conventional developing apparatus.

Next will be explained still another embodiment of the rotary member, referring to FIG. 10. The structure and operation of each component in FIG. 10 is the same as those of the bearing member in FIG. 13 which is the first embodiment of the invention but the tip of the small diameter part E of shaft section 433 in FIG. 10 is conical although the tip of the small diameter part E of shaft section 433 and the end face of the large-diameter part F of shaft section 433 in FIG. 13 are flat. Further, the end face B of the large-diameter part F of shaft section 433 has protrusions in parallel with the small diameter part E. The tip of each protrusion is tapered to be conical. The structures and operations of the other components are omitted as they are the same as those described in FIG. 13.

In FIG. 10, the tip of the small diameter part E of shaft section 433 in FIG. 10 is conical and the furthest end of the conical tip is round to have a small radius. When the conical tip hits the inner wall of developer container 46, the axial movement of the stirring and conveying screw 43A and 43B is limited. Since the tip of the small diameter part E of shaft section 433 is conical, the contact sliding area where the tip of the small diameter part touches the inner wall of developer container 46 is very small. Consequently, this mechanism can suppress grinding of toner particles by the sliding surface when the toner particles enter the sliding surface.

Further, the end face B of the large-diameter part F of shaft section 433 has four protrusions W of L mm long in parallel with the small diameter part E. The tip of each protrusion W is tapered to be conical and the top of the tip is rounded to a preset radius R. The tips of protrusions W are on a plane perpendicular to the central axis and in contact with the other end face A of bearing section 461 together with the tip of the small diameter part E of shaft section 433 to limit the axial movement of the stirring and conveying screw 43A and 43B.

In the above-explained embodiments, the tips of protrusions of bearing section 461 and shaft section 433 are all conical but the invention is not limited to this. The tips can be tapered or have any shape as long as the sectional area of each protrusion is small.

Further, the large-diameter part F of shaft section 433 has four protrusions on the end face B. However, it is to be understood that the invention is not intended to be limited to this number of protrusions.

Further, the ratio of protrusion length (L) to shaft diameter is preferably 0.05 to 0.5. Further, the protrusion length is preferably 1 to 10 mm. The shaft diameter represents a diameter of a portion of the shaft section on which the protrusions are provided. The shaft diameter D is indicated in each of FIGS. 4, 6, 7 and 9. If the protrusion is shorter, toner particles cannot move through the sliding space and the effect of the invention will not be easily obtained. If the protrusions become longer, the protrusions may be broken easier because of reduction in strength of protrusion without increasing the effect.

Further, the density of protrusions is preferably 5 to 500 protrusions per square inch. If more protrusions are provided, toner particles cannot move through the sliding space and the effect of the invention will not be easily obtained. If fewer protrusions are provided, the bearing must be greater to support the shaft rotatably.

Although the invention is described using shaft sections and bearing members for one pair of stirring and conveying screws 43A and 43B as rotary members in accordance with the invention, it is to be understood that the invention is not intended to be limited to the above embodiments. The rotary member can be a rotary paddle (44) or any other rotary member as long as it contains a clearance formed by a shaft section and a bearing member through which toner particles can move. The shape and size of the clearance can be determined arbitrarily.

Further, although the above description is made for an image forming apparatus which uses a two-component developer, the invention can be applied also to an image forming apparatus which uses single-component developer.

(Another Embodiment of the Image Forming Apparatus)

Below will be explained a preferred embodiment of an image forming apparatus which uses a single-component developer, referring to FIG. 11 and FIG. 12.

Figure 11:
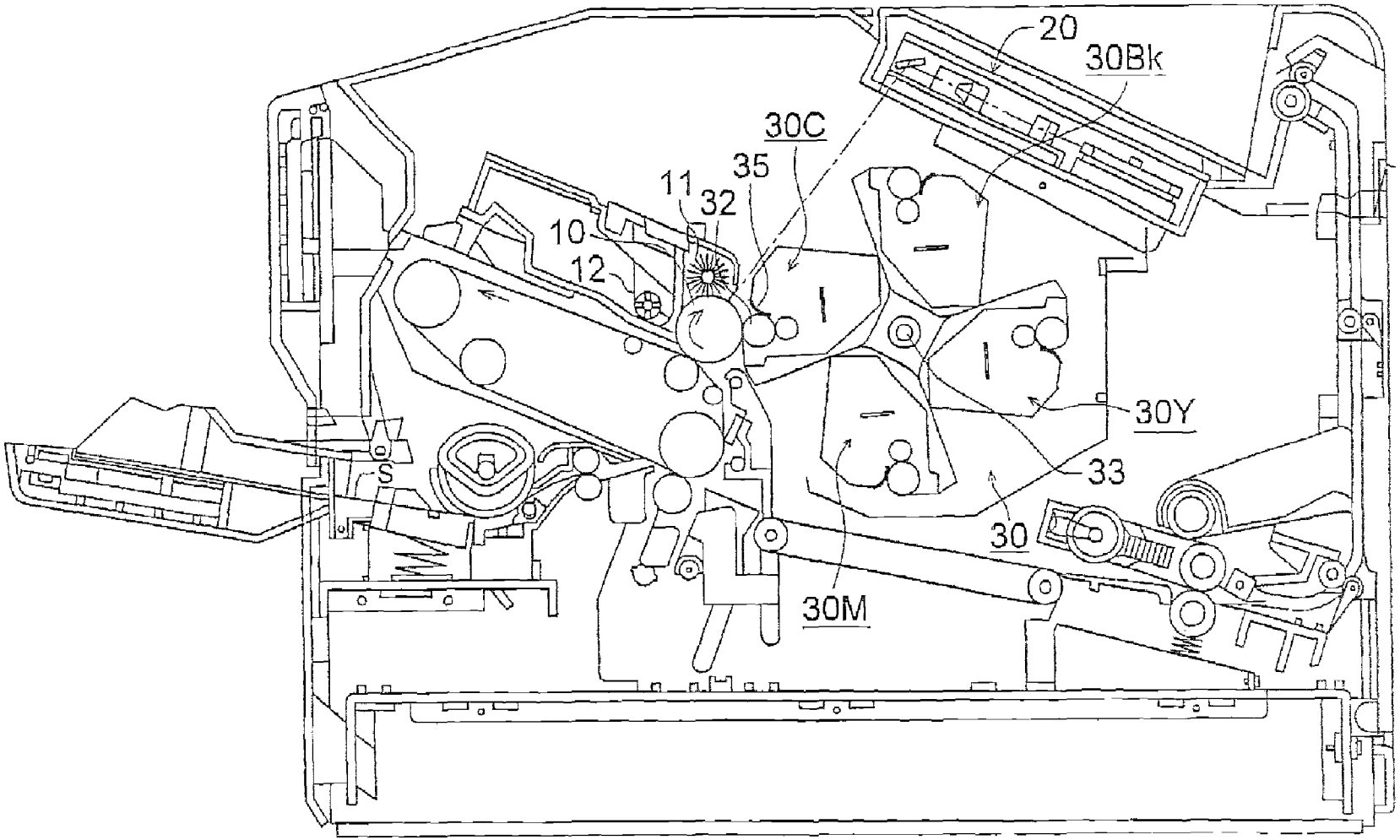
FIG. 11 is a sectional view of the image forming section of a color image forming apparatus equipped with a developing apparatus of another embodiment of the invention.

FIG. 11 is a sectional view of the image forming section of a color image forming apparatus equipped with a developing apparatus (using a single-component developer) of another embodiment of the invention. FIG. 12 is a sectional view of one of four developing units which constitute the developing apparatus (using a single-component developer) of another embodiment of the invention.

The full-color image forming apparatus of FIG. 11 is equipped near photoreceptor drum 10 with charging brush 11 to charge the surface of photoreceptor drum 10 evenly at a preset potential and cleaner 12 to scrape off toner particles which remain un-transferred on photoreceptor drum 10.

The full-color image forming apparatus is also equipped with laser scanning optical system 20 which scans photoreceptor drum 10 which is charged by charging brush 11 with a laser beam for exposure. This laser scanning optical system 20 is a well-known optical system equipped with a laser diode, a polygon mirror, and an f0 optical element. Its control section receives print data of each color (cyan, magenta, yellow, and black) from a host computer. The laser scanning optical system 20 outputs laser beams according to the print data of each color, scans and exposes the photoreceptor drum 10 to form an electrostatic latent image of each color in sequence on the photoreceptor drum 10.

The full-color developing apparatus (30) which performs full-color development by applying a toner of each color to the photoreceptor drum 10 which has electrostatic latent images thereon is equipped, around pivot 33, with four color developing units 30C for cyan, 30M for magenta, 30Y for yellow, and 30BK for black each of which contains non-magnetic single-component toner particles. These color developing units are rotated around the pivot 33 so that they may come to the developing position facing to the photoreceptor drum 10 in sequence.

(Another Embodiment of Developing Apparatus)

Figure 12:
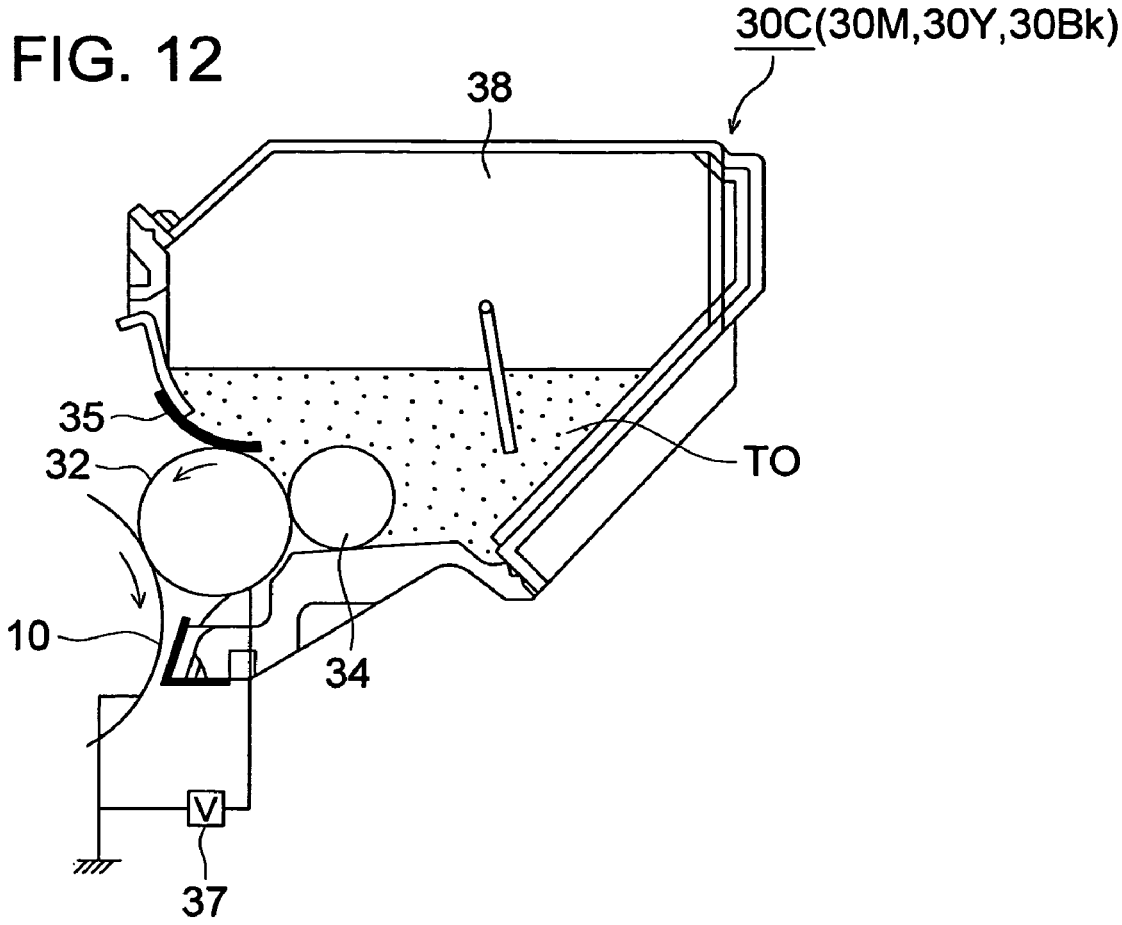
FIG. 12 is a sectional view of one of four developing units which constitute the developing apparatus of another embodiment of the invention.

FIG. 12 shows a sectional view of developing unit 30C which contains non-magnetic single-component toner of cyan whose structure is the same as the other developing units 30M, 30Y, and 30BK. So, the inventors explain only developing unit 30C and omit the explanation of the other developing units 30M, 30Y and 30BK.

Numeral 10 is a latent image retainer. A latent image is formed by an electro-photographic process unit or electrostatic recording unit (which is not shown in the drawing). Numeral 32 is a developing sleeve which is a non-magnetic sleeve made of aluminum or stainless steel.

A raw aluminum or stainless steel tube can be directly used as the developing sleeve 32, but it is preferable that its surface is made coarse by blasting glass beads or the like to the surface, treated to have a mirror-surface, or coated with a resin. The developing sleeve 32 is equivalent to that used by a magnetic single-component developing method.

Toner particles TO are stored in hopper 38 and fed onto the surface of the developing sleeve 32. Supply roller 34 made of a foamed material such as polyurethane foam rotates forward or backward at a speed relative to the speed of the developing sleeve 32 to supply the toner onto the surface of the developing sleeve 32 and rub off the toner (left after developing) from the surface of the developing sleeve 32. The toner on the developing sleeve 32 is controlled to be an even thin toner layer by a toner coating blade 35, which is a kind of toner-layer-thickness controlling members.

The toner-layer-thickness controlling member is preferably an elastic blade or roller which is made of a friction-charge-related material suitable to give a predetermined polarity to the toner. Preferable materials are silicone rubber, urethane rubber, and styrene-butadiene rubber. It is possible to facilitate movement of toner from the surface of the developing sleeve to the latent image retainer and to obtain high-quality images by giving, from a bias power supply 37, an alternate electric field or developing bias which is a superposition of alternate and direct-current electric fields between the developing sleeve 32 and the latent image retainer 10 as shown in FIG. 12.

The structure of the bearing member or rotary member in accordance with the invention is applicable to the developing sleeve 32 and the supply roller 34.

Next will be explained toners to be used by the developing apparatus in accordance with the invention.

Toner particles used by the invention have a number median diameter of 3 to 8 μm and preferably 4.5 to 7 μm. The number median diameter is defined as the mean particle diameter (50% diameter) such that 50% of particles by number in the distribution are of smaller diameters. The number median diameter of toner particles can be controlled by the concentration, supply timing, and temperature of a coagulant (salting-out agent) in its production process.

The developing apparatus in accordance with the invention provides the above-mentioned clearance in each bearing section which holds a rotary member to prevent stagnation of such small toner particles in the bearing sections and resulting coagulation and fusion-bonding of toner particles. Further, since the developing apparatus in accordance with the invention will not deteriorate the intrinsic performance of such small diameter toner particles, the small diameter toner particles can fully exert their intrinsic performance. In other words, toner particles whose number median diameter is 3 to 8 μm and preferably 4.5 to 7 μm enable high-fidelity reproduction of thin lines and fine dots and consequently such toner particles are preferably available to digital image formations.

The number median diameters of toner particles can be measured and calculated by a test system made up with Coulter Multisizer II (made by Beckman Coulter) and a data-processing computer system (made by Beckman Coulter).

The inventors measured the number median diameter of toner particles by taking the steps of moistening 0.02 g of toner particles with 20 ml of surfactant solution (for example prepared by diluting 1 part of neutral detergent which contains a surfactant with 9 parts of pure water to promote dispersion of toner particles), ultrasonically dispersing toner particles in the solution for one minute, putting the resulting toner dispersion liquid in a vial (beaker) which contains ISOTON II (prepared by Beckman Coulter) in the sample stand until the concentration of toner particles reach the test concentration 5 to 10% with a pipette, setting a particle count to 30,000 on Coulter Multisizer II, and starting measurement. In this case, the aperture diameter used by Coulter Multisizer is 50 μm.

The glass-transition temperature of toners used by the invention is preferably 30° C. or higher but not exceeding 60° C. If the glass-transition temperature is lower than 30° C., toner particles may be easily fixed even when no stress is on them. This may not assure image qualities and the reliability of the image forming apparatus. If the glass-transition temperature exceeds 60° C., it is hard to assure the fixability with low thermal energy.

The glass-transition temperature of toner particles used by the invention is measured by DSC-7 differential scanning calorimeter (made by Perkin-Elmer) and TAC/DX thermal analyzer controller (made by Perkin-Elmer).

The inventors measured the glass-transition temperature of the toner by taking the steps of exactly weighing 4.5 to 5.0 mg of the toner to an accuracy of two places of decimals, sealing weighed toner in an aluminum pan (Kit No. 0219-0041), setting it in the DSC-7 sample holder, measuring while changing the temperature (heating-cooling-heating) under conditions of a test temperature of 0 to 200° C., a temperature rise rate of 10° C./min, a temperature fall rate of 10° C./min, and analyzing on the basis of data obtained during second heating. The inventors used an empty aluminum pan as a reference.

The glass-transition temperature is obtained from the intersection of an extension of the base line on which the first endothermic peak starts to rise and a tangential line having a maximum inclination between the root of the first peak and the top of the peak.

The developing apparatus in accordance with the invention provides the above-mentioned clearance in each bearing section which holds a rotary member to prevent stagnation of such small toner particles in the bearing sections and resulting coagulation and fusion-bonding of toner particles. Further, since the developing apparatus in accordance with the invention will not deteriorate the intrinsic performance of such small diameter toner particles, the small diameter toner particles can fully exert their intrinsic performance. In other words, toner particles whose number median diameter is 3 to 8 μm and preferably 4.5 to 7 μm enable high-fidelity reproduction of thin lines and fine dots and consequently such toner particles are preferably available to digital image formations.

(Preparation of Emulsification Aggregation Type Toner particles)

Next will be explained a method of producing toners available to the invention.

The toner available to the invention preferably contains a resin which is prepared by polymerizing a polymerizable monomer in a water-based medium. This resin preparation uses a suspension polymerization method which polymerizes monomers in a suspension, an emulsion polymerization method which polymerizes monomers in a solution (water-based medium) which contains an emulsion of a required additive, or a mixture of a mini-emulsion polymerization and other method preparing fine resin particles by a mini-emulsion polymerization, adding charge-controlling resin particles thereto, adding a coagulant such as an organic solvent and salt thereto, and coagulating and fusion-bonding thereof.

<Suspension Polymerization Method>

This is one of methods of preparing toners available to the invention. This method dissolves a charge controllable resin in a polymerizable monomer, adds a coloring agent, and other components such as mold-releasing agent and polymerization initiator if necessary to the solution, dissolves or disperses the components in the solution by a homogenizer, sand mill, sand grinder, or ultrasonic dispersing machine, puts the resulting monomer solution in which the components are dissolved or dispersed in a water-based medium which contains a dispersion stabilizer, disperses the polymerizable monomer in the water-based medium into oil droplets of a preset particle size by a homomixer or homogenizer, transfers the dispersion liquid to a reactor (a stirring device) whose stirring mechanism has stirring blades to be explained later, heats the liquid in the reactor to advance the polymerization reaction, removes the dispersion stabilizer after the reaction is complete, filters, rinses, and dries the product. The "water-based medium" in the invention means a medium which contains at least 50% by mass of water.

<Emulsion Polymerization Method>

Another method prepares toners available to the invention by salting out or fusion-bonding resin particles in a water-based medium. This method has been disclosed by Japanese Non-Examined Patent Publications H05-265252, H06-329947, and H09-15904.

In other words, this method contains a process to salt out, coagulate, and fusion-bond dispersed particles of components such as resin particles and coloring agents or fine particles which contain resin and coloring agents. Specifically, this method disperses particles in water by an emulsifying agent, adds an coagulating agent whose concentration is higher than the critical coagulation concentration to salt out particles, and simultaneously heats and fusion-bonds the polymer product at the glass transition temperature of the polymer or higher. In this case, the salting out process and the fusion-bonding process need not be an identical process. The heating and fusion-bonding process gradually increases the particle sizes while forming particles. When the particle size reaches a target size, a lot of water is added to the solution to stop the growth of the particles.

Then, the dispersion liquid is heated and stirred to make particle surfaces smooth and dried while the wet particles are flown. With this, a toner available to the invention is prepared. Here, the coagulating agent can be added together with a solvent such as alcohol which can dissolve in water infinitely.

To prepare available toner particles, the invention preferably uses a method of dissolving an ester compound of a specific structure in a polymerizable monomer, polymerizing the monomer, and salting out or fusion-bonding the resulting composite resin particles and coloring agent particles. When an ester compound of a specific structure is dissolved in a polymerizable monomer, the ester compound can be added in a solution form or-in a fusion status.

Further, another preferable method of preparing a toner available to the invention salts out or fusion-bonds fine composite resin particles which are prepared by a multi-stage polymerization method.

Next will be explained one of preferable toner producing methods (emulsion aggregation method) in detail.

This method may contain the following processes:

(1) A process of dissolving an ester compound of a specific structure in a radical polymerizable monomer;

(2) A polymerization process of preparing a dispersion liquid of fine resin particles;

(3) A fusion-bonding process of fusion-bonding fine resin particles in a water-based medium (to obtain a toner of aggregated particles);

(4) A process of cooling the dispersion liquid of toner particles;

(5) A process of separating solid components (toner particles) from the cooled toner dispersion liquid and removing unwanted agents (i.e. surfactant) from the toner particles;

(6) A process of drying rinsed toner particles; and (7) An optional process of adding external additives to the dried toner particles (if necessary).

Each of the above processes will be explained in detail.

[Dissolving Process]

This process dissolves an ester compound of a specific structure in a radical polymerizable monomer to prepare a radical polymerizable monomer solution of an ester compound of a specific structure.

[Polymerization Process]

A preferred example of polymerization process forms liquid droplets of the above radical polymerizable monomer solution of an ester compound of a specific structure in a water-based medium (aqueous solution of surfactant and radical polymerization initiator) and advances polymerization in the liquid droplets by radicals emitted from the radical polymerization initiator. An oil-soluble polymerization initiator can be contained in the liquid droplets in advance. This polymerization process requires mechanical energy to forcibly emulsify the liquid (to form liquid droplets). Representative mechanical energy supply sections can be a stirring section (such as a homomixer, ultrasonic waves, and Manthon Gaulin) and an ultrasonic vibration energy supply section.

This polymerization provides fine resin particles which contain an ester compound of a specific structure and a binding resin. There are two kinds of fine resin particles: colored fine particles which contain coloring agents and un-colored fine particles. The colored fine resin particles can be prepared by adding a coloring agent to a monomer composition and polymerizing the mixture. The un-colored fine particles can be prepared by adding a dispersion liquid of fine particles of a coloring agent to the dispersion liquid of fine resin particles in the fusion-bonding process and fusion-bonding the resin particles and the coloring agent particles.

[Fusion-bonding Process]

A preferred fusion-bonding method is a salting-out/fusion-bonding method which uses fine resin particles prepared by a polymerization process. The fusion-bonding process fusion-bonds fine particles of internal additives such as mold-releasing and charge controlling agents besides fine particles of resin and coloring agents.

The water-based medium used in fusion-bonding process means a medium which contains at least 50% by mass of water. Here, components except for water can be water-soluble organic solvents such as methanol, ethanol, isopropanol, butanol, acetone, methylethylketone, and tetrahydrofuran. Among these, most preferable are alcohol organic solvents such as methanol, ethanol, isopropanol, and butanol which do not dissolve the resin.

Fine particles of a coloring agent are prepared by dispersing the coloring agent in a water-based medium. Dispersion of the coloring agent is carried out while the concentration of a surfactant in water is the critical micelle concentration (CMC) or higher. Any dispersing machine can be used to disperse coloring agents. Preferable dispersing machines are pressure-type dispersing machines (such as an ultrasonic dispersing machine, a mechanical homogenizer, and a Manton Gaulin) and medium type dispersing machines (such as a sand grinder, a Getzman mill and a diamond fine mill).

The above-described surfactants are available as the surfactants for the invention. It is also possible to use coloring agents (fine particles) whose surfaces are modified. The surface of a coloring agent can be modified by dispersing the coloring agent in a solvent, adding a surface modifying agent to the dispersion liquid, heating the mixture to react, waiting until the reaction is completed, filtering the coloring agent, rinsing and filtering thereof using the solvent, and drying-thereof. The obtained product is a surface-modified coloring agent (pigment).

A salting-out and fusion-bonding method which is a preferred mode of a fusion-bonding method takes steps of adding a salting-out agent (which contains alkaline metal salt or alkaline earth metal salt) of a critical coagulation concentration or higher into a liquid which contains fine particles of resin and coloring agents, heating the mixture to a temperature which is over the glass transition temperature of the fine resin particles and over the fusion-peak temperature of the ester compound of a specific structure in the resin particles, and advancing salting out and fusion-bonding simultaneously. In this process, it is possible to make fusion-bonding effective by adding an organic solvent which is infinitely soluble to water to reduce the glass-transition temperature of the fine resin particles substantially.

Alkaline metal salts working as a salting-out agent are salts of lithium, potassium, and sodium. Alkaline earth metal salts working as a salting-out agent are salts of magnesium, calcium, strontium, barium and so on. Among these metals, potassium, sodium, magnesium, calcium, and barium are preferably used. Further, salts of these metals can be chlorides, bromides, iodides, carbonates, sulfates and so on.

Organic solvents which are infinitely soluble to water are methanol, ethanol, 1-propanol, 2-propanol, ethylene glycol, glycerin, acetone and so on. Alcohols of up to three carbon atoms (per molecule) such as methanol, ethanol, 1-propanol, and 2-propanol are preferable. Among these alcohols, 2-propanol is particularly preferable.

In the salting-out and fusion-bonding method, it is preferable to make a salt-out time as short as possible after adding a salting-out agent. This is because the coagulation status of particles may change during this salt-out time. This makes the particle size distribution unstable and changes the surface property of the fusion-bonded toner particles. Further, the salting-out agent is added when the liquid temperature is the glass-transition temperature of the resin particles or lower. This is because, if the salting-out agent is added when the liquid temperature is higher than the glass-transition temperature of the resin particles, fine resin particles are promptly salted out and fusion-bonded and particles may become greater in size than expected. Therefore, the temperature at which the salting-out agent is added should be the glass-transition temperature of the resin or lower, preferably 5 to 55° C., and more preferably 10 to 45° C. The heating period after addition of the salting-out agent is preferably shorter than 1 hour. The heating rate is preferably 0.25° C./min or higher. This fusion-bonding process can provide a dispersion liquid of associated particles (toner particles) in which fine resin particles and other fine particles are salted out and fusion-bonded.

[Cooling Process]

This process cools the dispersion liquid of toner particles (quickly) at a cooling rate of 1 to 20° C./min. Any cooling method is available, for example, a method of introducing a coolant from the outside of the reactor container into the reactor or a method of feeding cooling water directly into the reaction system.

[Solid-liquid Separation and Rinsing Process]

This process contains a solid-liquid separation process which separates toner particles from a dispersion liquid of toner particles which is cooled down to a preset temperature in the above cooling process and a rinsing process which washes a wet toner cake (aggregate of toner particles) obtained in the solid-separation process to remove the surfactant and the salting-out agent. Solid-liquid separation methods available are a centrifuge separation method, a vacuum-filtration method which uses a Buchner funnel or the like, and a filtration method which uses a filter press or the like.

[Drying Process]

This process dries the washed toner cake into dry toner particles. This process uses a spray dryer, vacuum-freeze dryer, vacuum dryer, stationary shelf dryer, mobile shelf dryer, fluidized-bed dryer, tumble-drier, and stirring type dryer. The water content of the dried toner particles is preferably 5% or less by mass and more preferably 2% or less by mass.

The dried toner particles will coagulate together by weak inter-particle forces. The agglomerated toner particles are crumbed by a mechanical crumbing machine such as jet mill, HENSCHEL MIXER, coffee mill, and food processor.

[Process of Adding External Additives]

This process adds external additives to the dried toner particles if necessary and mixes them up by a mechanical mixing machine such as HENSCHEL MIXER and a coffee mill.

Black toner particles and color toner particles can be prepared by the methods of the invention.

Next will be explained compounds (binding resin, coloring agent, mold-releasing agent, charge-controlling agent, external additives, and lubricant), which constitute toners used by the invention.

(Binding Resin)

Binding resins which constitute toner particles are specifically:

styrenes (polystyrene, poly-p-chloro styrene, and polyvinyl toluene) and copolymers of their substitution;

styrene copolymers such as styrene-p-chloro styrene copolymer, styrene-vinyl toluene copolymer, styrene-vinyl naphthalene copolymer, styrene-acrylic ester copolymer, styrene-methacrylic ester copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, and styrene-acrylonitrile-indene copolymer; and resins such as polyvinyl chloride resin, phenol resin, natural-resin-modified phenol resin, natural-resin-modified maleic acid resin, acrylic resin, methacrylic resin, polyvinyl acetate resin, silicone resin, polyester resin, polyurethane resin, polyamide resin, furan resin, epoxy resin, xylene resin, polyvinyl butyral resin, terpene resin, coumarone-indene resin, and petroleum resin.

Monomers to be used together with styrene monomers (styrene copolymers) are:

monocarboxylic acids having a double bond or their substitution such as acrylic acid, methyl acrylate, ethyl acrylate, butyl acrylate, dodecyl acrylate, octyl acrylate, 2-ethyl hexyl acrylate, phenyl acrylate, methacrylic acid, methyl methacrylate, ethyl methacrylate, butyl methacrylate, octyl methacrylate, acrylonitrile,.methacry nitrile, and acrylamide;

dicarboxylic acids having a double bond and their substitution such as maleic acid, butyl maleate, methyl maleate, and dimethyl maleate;

vinyl esters such as vinyl chloride, vinyl acetate, and vinyl benzoate;

ethylene olefins such as ethylene, propylene, and butylene;

vinyl ketones such as vinyl methyl ketone and vinyl hexyl ketone; and vinyl ethers such as vinyl methyl ether, vinyl ethyl ether, and vinyl isobutyl ether.

These vinyl monomers are used singly or in combination as monomers to form the copolymer.

The resins for binding toner particles also contain a mixture of the above resins or cross-linked resins. Cross-linking agents to cross-link binding resins are compounds having two or more double bonds that can be polymerized. Specifically, the compounds are:

aromatic divinyl compounds such as divinyl-benzene and divinyl naphthalene;

carboxylate ester having two or more double bonds such as ethylene glycol diacrylate, ethylene glycol dimethacrylate, and 1,3-butadiol dimethacrylate;

divinyl compounds such as divinyl aniline, divinyl ether, divinyl sulfide, and divinyl sulfone; and compounds having three or more vinyl groups.

These compounds are used singly or in combination to form cross-linking structures.

(Coloring Agents)

Representative organic pigment and dyes are listed below.

Black pigments are carbon black such as furnace black, channel black, acetylene black, thermal black, and lamp black, and magnet powder such as magnetite and ferrite.

Coloring agents for magenta or red pigments are:

C.I. pigment red 2, C.I. pigment red 3, C.I. pigment red 5, C.I. pigment red 6, C.I. pigment red 7, C.I. pigment red 15, C.I. pigment red 16, C.I. pigment red 48; 1, C.I. pigment red 53; 1, C.I. pigment red 57; 1, C.I. pigment red 122, C.I. pigment red 123, C.I. pigment red 139, C.I. pigment red 144, C.I. pigment red 149, C.I. pigment red 166. C.I. pigment red 177, C.I. pigment red 178, and C.I. pigment red 222.

Coloring agents for orange or yellow pigments are:

C.I. pigment orange 31, C.I. pigment orange 43, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, and C.I. pigment yellow 138.

Coloring agents for green or cyan pigments are:

C.I. pigment blue 15, C.I. pigment blue 15; 2, C.I. pigment blue 15; 3, C.I. pigment blue 15; 4, C.I. pigment blue 16, C.I. pigment blue 60, pigment blue 62, pigment blue 66, and C.I. pigment green 7.

These coloring agents can be selected and used singly or in combination if necessary. The rate of coloring agents to be added to the whole toner particles is 1 to 30% by mass and preferably 2 to 20% by mass.

(Mold-releasing Agents)

Toner particles of the invention can use, as mold-releasing agents, ester compounds of specific structures, hard paraffin wax, micro wax, rice wax, fatty acid amide wax, fatty acid wax, fatty acid monoketones, fatty acid metallic salt wax, fatty acid ester wax, partially-saponified fatty acid ester wax, silicone varnish, higher alcohol, and carnauba wax. Further, polyolefins such as low-molecular-weight polyethylenes and polypropylenes can also be used as mold-releasing agents. Their softening points (measured by a ring and ball method) are 70 to 150° C. and preferably 120 to 150° C. The content of a mold-releasing agent is 0.1 to 20.0% by mass (to the whole toner particles).

Next will be shown examples of ester compounds of specific structures which are preferably used by the invention.

[Structural formulas 1]

1)

$$CH_3-(CH_2)_{12}-COO-(CH_2)_{17}-CH_3$$

2)

$$CH_3-(CH_2)_{18}-COO-(CH_2)_{17}-CH_3$$

3)

$$CH_3-(CH_2)_{20}-COO-(CH_2)_{21}-CH_3$$

4)

$$CH_3-(CH_2)_{14}-COO-(CH_2)_{19}-CH_3$$

5)

$$CH_3-(CH_2)_{20}-COO-(CH_2)_6-O-CO-(CH_2)_{20}-CH_3$$

6)

$$CH_3-(CH_2)_{20}-COO-(CH_2)_2-\underset{}{\overset{CH_3}{\overset{|}{CH}}}-CH_2-O-CO-(CH_2)_{20}-CH_3$$

7)

$$CH_3-(CH_2)_{22}-COO-(CH_2)_2-\overset{CH_3}{\overset{|}{CH}}-CH_2-O-CO-(CH_2)_{22}-CH_3$$

8)

$$CH_3-(CH_2)_{22}-COO-CH_2-\underset{\underset{CH_3}{|}}{\overset{\overset{CH_3}{|}}{C}}-CH_2-O-CO-(CH_2)_{22}-CH_3$$

9)

$$CH_3-(CH_2)_{26}-COO-CH_2-\underset{\underset{CH_3}{|}}{\overset{\overset{CH_3}{|}}{C}}-CH_2-O-CO-(CH_2)_{26}-CH_3$$

10)

$$\begin{array}{l} CH_2-O-CO-(CH_2)_{26}-CH_3 \\ | \\ CH-O-CO-(CH_2)_{26}-CH_3 \\ | \\ CH_2-O-CO-(CH_2)_{26}-CH_3 \end{array}$$

11)

$$\begin{array}{l} CH_2-O-CO-(CH_2)_{22}-CH_3 \\ | \\ CH-O-CO-(CH_2)_{22}-CH_3 \\ | \\ CH_2-O-CO-(CH_2)_{22}-CH_3 \end{array}$$

12)

$$\begin{array}{l} CH_2-OH \\ | \\ CH-O-CO-(CH_2)_{26}-CH_3 \\ | \\ CH_2-O-CO-(CH_2)_{26}-CH_3 \end{array}$$

13)

$$\begin{array}{l} CH_2-OH \\ | \\ CH-O-CO-(CH_2)_{22}-CH_3 \\ | \\ CH_2-O-CO-(CH_2)_{22}-CH_3 \end{array}$$

14)

$$\begin{array}{l} CH_2-OH \\ | \\ CH-OH \\ | \\ CH_2-O-CO-(CH_2)_{26}-CH_3 \end{array}$$

-continued

15)

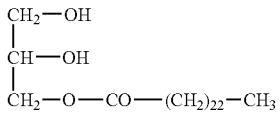

[Structural formulas 2]

16)

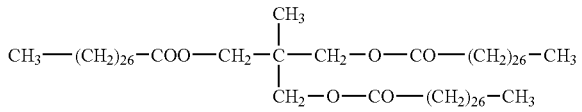

17)

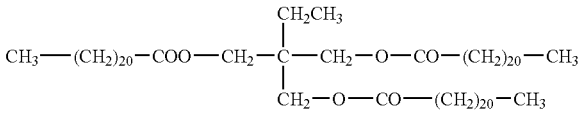

18)

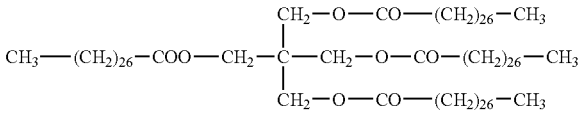

19)

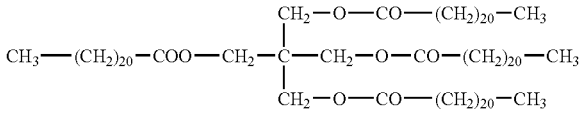

20)

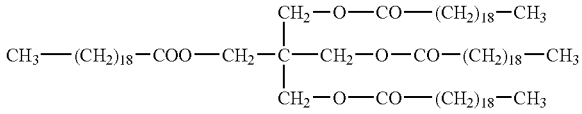

21)

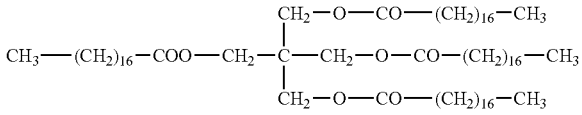

(Charge Controlling Agents)

Charge controlling agents can be added to toners used by the invention if necessary. Specifically, charge controlling agents are nigrosin dye, metallic salts of naphthenic acid and higher fatty acid, alkoxylated amine, quaternary ammonium salt compound, azo metal complexes, metal salicylate or their metal complexes. Metals to be contained are Al, B, Ti, Fe, Co, Ni, and so on. Metallic complexes of benzilic acid derivatives are preferably used as a charge controlling agent. The content of the charge controlling agent is 0.1 to 20.0% by mass (to the whole toner particles).

(External Additives)

So-called external additives can be added to toners used by the invention to improve the flowability, electrostatic property, and cleaning ability of the toners. External additives are inorganic particles, organic particles, and lubricants.

Specifically, inorganic particles are selected from silica, titania, alumina, and strontium titanate particles. These inorganic particles can be made hydrophobic for use. Commercially-available silica particle products are R-805, R-976, R-974, R-972, R-812, and R-809 (mfd. by Nihon Aerosil Co., Ltd.), HVK-2150 and H-200 (mfd. by Hoechst), TS-720, TS-530, TS-610, H-5, and MS-5 (mfd. by CABOT Japan Co., Ltd.), and so on.

Commercially-available titania particle products are T-805 and T-604 (mfd. by Nihon Aerosil Co., Ltd.), MT-100S, MT-100B, MT-500BS, MT-600, MT-600SS, and JA-1 (mfd. by Tayca Co., Ltd.), TA-300SI, TA-500, TAF-130, TAF-510, TAF-510T (mfd. by Fuji Titanium Industry Co., Ltd.), and IT-S, IT-OA, IT-OB, and IT-OC (mfd. by Idemitsu Kosan Co., Ltd.).

Commercially-available alumina particle products are RFY-C and C-604 (mfd. by Nihon Aerosil Co., Ltd.) and TTO-55 (mfd. by Ishihara Sangyo Kaisha, Ltd).

Spherical organic particles having a numeric average primary grain size of about 10 to 2000 nm are available as organic particles used by the invention. Specifically, they are homopolymers and copolymers of styrene and methyl methacrylate.

The content of external additives is preferably 0.1 to 10.0% by mass (to the whole toner particles). External additives are added by a mixing machine such as a turbular mixer, a HENSCHEL MIXER, a Nautor type mixer, and a V-shaped mixer.

(Lubricants)

It is also possible to add lubricants to the toners used by the invention to improve the cleaning ability and transferability of the toners. Specifically, available lubricants are metallic salts of higher fatty acids such as stearates of zinc, aluminum, copper, magnesium, and calcium; oleates of zinc, manganese, iron, copper, and magnesium; palmitates of zinc, copper, magnesium, and calcium; linoleates of zinc and calcium; and ricinoleates of zinc and calcium.

The rate of lubricants to be added to the whole toners is preferably 0.1 to 10.0% by mass. Lubricants are added by a mixing machine such as a turbular mixer, a HENSCHEL MIXER, a Nautor type mixer, and a V-shaped mixer.

Toners of the invention can be used for single-component and two-component developer. There are two kinds of single-component developer: non-magnetic single-component developer and magnetic single-component developer which contain magnetic particles of about 0.1 to 0.5 μm in the toner.

When the toner is used for a two-component developer, the toner is mixed up with a carrier which is made of magnetic particles such as iron, ferrite, and magnetite particles which contain iron. Particularly, ferrite particles or magnetite particles are preferable.

The number median diameter of the carrier is 15 to 100 μm and preferably 20 to 80 μm. The number median diameters of carriers are measured by Laser Diffraction Particle Size Analyzer HELOS (mfd. by SYMPATEC).

Preferable carriers are coated carriers whose magnetic particles are coated with resin and resin-dispersed carriers which contain magnetic particles in resin. Resins for coating magnetic particles are for example, olefin resin, styrene resin, styrene-acrylic resin, silicone resin, ester resin, and fluorine-containing polymer resin. Resins for resin-dispersed carriers are for example, styrene-acrylic resin, polyester resin, fluorine resin, and phenol resin.

The ratio (by mass) of carrier to toner in the two-component developer is preferably 1:1 to 50:1.

[Embodiments]

In the following examples are described several preferred embodiments to illustrate the invention. However, it is to be understood that the invention is not intended to be limited to the specific embodiments. In the description of Embodiments below, "parts" means "parts by mass."

[Preparation of Toners]

(A) Preparation of Two-component Developer (1) Synthesis of Latex-1

The inventors put 509.83 g of styrene, 88.67 g of n-butyl acrylate, 34.83 g of methacrylic acid, 21.83 g of tert-dodecyl mercaptan, and 66.7 g of ester compound (20) in a 4-neck flask equipped with a stirrer, a cooling pipe, and a temperature sensor, heated the mixture to 80° C., stirred the mixture until the ester compound (20) dissolved completely, and held the mixture (monomer solution) at the temperature. Separately, the inventors dissolved 1.0 g of sodium dodecyl benzene sulfonate in 2700 milliliter of pure water to prepare an aqueous solution of the surfactant, heated the solution to 80° C., and held the solution at the temperature. The inventors put the monomer solution (containing the ester compound (20)) into the aqueous surfactant solution while stirring the aqueous surfactant solution at 80° C. and emulsified the mixture by an ultrasonic emulsifying machine. Then the inventors put this emulsion in a 4-neck flask equipped with a stirrer, a cooling pipe, a nitrogen gas pipe, and a temperature sensor, kept stirring the emulsion at 70° C. while supplying nitrogen gas, added an aqueous solution of a polymerization initiator (prepared by dissolving 7.52 g of ammonium persulfate in 500 milliliter of pure water), continued polymerization for 4 hours, cooled the solution down to room temperature, filtered the solution, and obtained latex. After polymerization, the inventors found no residue of reaction. The obtained latex is stable. This latex is named "latex-1."

The inventors measured the number average primary particle diameter of latex-1by Electrophoretic Light Scattering Photometer ELS-800 (mfd. by Otsuka Electronics Co., Ltd). The number average primary particle diameter of latex-1is 125 nm. The glass-transition temperature of latex-1is 50° C. (measured by DSC).

(2) Synthesis of Latex-2

The inventors put 92.47 g of styrene, 30.4 g of n-butyl acrylate, 3.80 g of methacrylic acid, 0.12 g of tert-dodecyl mercaptan, and 13.34 g of ester compound (20) in a 4-neck 1-liter flask equipped with a stirrer, a cooling pipe, and a temperature sensor, heated the mixture to 80° C., stirred the mixture until the ester compound (20) dissolved completely, and held the mixture (monomer solution) at the temperature.

Separately, the inventors dissolved 0.27 g of sodium dodecyl benzene sulfonate in 540 milliliter of pure water to prepare an aqueous solution of the surfactant, heated the solution to 80° C., and held the solution at the temperature.

We put the monomer solution (containing the ester compound (20)) into the aqueous surfactant solution while stirring the aqueous surfactant solution at 80° C. and emulsified the mixture by an ultrasonic emulsifying machine. Then the inventors put this emulsion in a 4-neck 5-liter flask equipped with a stirrer, a cooling pipe, a nitrogen gas pipe, and a temperature sensor, kept stirring the emulsion at 70° C. while supplying nitrogen gas, added an aqueous solution of a polymerization initiator (prepared by dissolving 0.27 g of ammonium persulfate in 100 milliliter of pure water), continued polymerization for 4 hours, cooled the solution down to room temperature, filtered the solution, and obtained latex. After polymerization, the inventors found no residue of reaction. The obtained latex is stable. This latex is named "latex-2."

The inventors measured the number average primary particle diameter of latex-2 by Electrophoretic Light Scattering Photometer ELS-800 (mfd. by Otsuka Electronics Co., Ltd). The number average primary particle diameter of latex-2 is 108 nm. The glass-transition temperature of latex-2 is 77° C. (measured by DSC).

(3) Synthesis of Latex-3

The inventors put an activator solution (prepared by dissolving 0.71 g of sodium dodecyl benzene sulfonate (SDS) as an anionic activator in 540 milliliter of ion exchanged water) in a 4-neck flask equipped with a stirrer, a cooling pipe, a temperature sensor and a nitrogen gas pipe, heated the solution to 80° C., and kept stirring the solution at 230 rpm. while supplying nitrogen gas.

Separately, the inventors mixed 62.5 g of styrene, 37.5 g of 2-ethyl hexyl acrylate, 25.0 g of maleic acid, and 13.34 g of ester compound (20), heated the mixture to 80° C. until the components dissolve completely. The inventors mixed the prepared monomer solution and the activator solution and made a dispersion solution of them by a mechanical dispersing machine having a circulation pipe. The inventors obtained an emulsion of particles of a uniform particle size. The inventors added a solution of polymerization initiator (prepared by dissolving 0.84 g of potassium persulfate (KPS) in 200 g of ion exchanged water) in the emulsion and stirred the mixture for 3 hours at 80° C. This resulting latex is named "latex-3."

The inventors measured the number average primary particle diameter of latex-3 by Electrophoretic Light Scattering Photometer ELS-800 (mfd. by Otsuka Electronics Co., Ltd). The number average primary particle diameter of latex-3 is 115 nm. The glass-transition temperature of latex-3 is 27° C. (measured by DSC). The concentration of a solid content in latex-3 is 20% by mass (measured by a stationary drying and weighing method).

(4) Preparation of a Toner

The inventors put 750 g (60% by mass) of latex-2, 500 g (40% by mass) of latex-l, 900 milliliter of pure water, and a carbon black dispersion liquid (prepared by 20 g of carbon black "Legal 330R" (mfd. by CABOT) in an aqueous solution of surfactant (containing 9.2 g of sodium dodecyl benzene sulfonate in 160 milliliter of pure water)) in a 4-neck 5-liter flask equipped with a stirrer a cooling pipe, and a temperature sensor, and added 5N sodium hydroxide solution to the mixture to control pH to 10 while stirring the mixture.

The inventors added an aqueous solution of a salting-out agent (prepared by dissolving 28.5 g of magnesium chloride hexahydrate in 1000 milliliter of pure water) into the above solution at room temperature, heated the solution to 95° C., measured the particle size of the dispersed particles in the solution by "Coulter Counter II" (mfd. by Coulter) at 95° C., added an aqueous alkaline solution (prepared by dissolving 80.6 g of sodium chloride in 700 milliliter of pure water) when the particle size reaches 3.0 μm, and continued reaction for 6 hours at 95° C. After the reaction is completed, we cooled the dispersion solution (95° C.) of the associated particles 10 minutes down to 45° C. (at a cooling rate of 5° C./min), filtered the dispersion solution, dispersing the filtered associated particles again in pure water, filtered the solution again, and dried the filtered associated particles. The resulting product is named "toner 1." Table 1 shows the number median diameter and the glass-transition temperature of toner-1.

In similar ways, the inventors prepared toner-2 to toner 10 according to the latex ratios listed in Table 1. Table 1 also lists the number median diameter and the glass-transition temperature of each product. The physical property values in Table 1 were measured by the same method. as Toner 1.

TABLE 1

| Toner | Latex ratio (% by mass) | | | Number median diameter | Glass-transition temperature |
|---|---|---|---|---|---|
| No. | Latex 1 | Latex 2 | Latex 3 | (μm) | (° C.) |
| Toner-1 | 40% | 60% | — | 3.0 | 70 |
| Toner-2 | 40% | 60% | — | 6.0 | 70 |
| Toner-3 | 60% | 40% | — | 8.0 | 55 |
| Toner-4 | 60% | 40% | — | 4.5 | 55 |
| Toner-5 | 15% | 85% | — | 6.0 | 75 |
| Toner-6 | 30% | — | 70% | 7.5 | 30 |
| Toner-7 | 60% | — | 40% | 6.0 | 45 |
| Toner-8 | 15% | — | 85% | 6.0 | 28 |
| Toner-9 | 60% | — | 40% | 8.5 | 45 |
| Toner-10 | 60% | 40% | — | 2.5 | 55 |

Then the inventors added 1% by mass of hydrophobic silica (numeric average primary grain size of 12 nm and degree of hydrophobicity of 68) and W by mass of hydrophobic titanium oxide (numeric average primary grain size of 20 nm and degree of hydrophobicity of 63) to each of Toner-1 to Toner-10, mixed each toner solution by HENSCHEL MIXER (mfd. by Mitsui Miike Chemical Engineering), sieved away large particles with a sieve of 45 μm mesh, and thus obtained Toner-1 to Toner-10.

(5) Preparation of Two-component Developer

The inventors added and mixed a ferrite carrier having a number median diameter of 60 μm (which is coated with silicone resin) to each of Toner-1 to Toner-10 so that the concentration of each toner may be 6% by mass. Thus, the inventors obtained two-component developer.

(B) Preparation of Single-component Developer (1) Polymerization Process

The inventors prepared a dispersion liquid of carbon black by putting 533.5 g of carbon black (Legal 330R manufactured by CABOT) which is treated by an aluminum coupling agent in an aqueous solution (prepared by dissolving 246 g of sodium dodecyl benzene sulfonate in 6 liters of pure water), and applying ultrasonic waves to the mixture while stirring it. Separately, the inventors prepared a dispersion liquid (emulsion) of low-molecular-weight polypropylene (containing 20W by mass of solid components) by stirring low-molecular-weight polypropylene (number average molecular weight of 3200) in an aqueous solution of surfactant while heating the solution.

The inventors put 2150 g of the dispersion liquid (emulsion) of low-molecular-weight polypropylene in the dispersion liquid of carbon black, stirred the mixture, added the mixture to a monomer solution (prepared by putting 4905 g of styrene monomer, 820 g of n-butyl acrylate, 245 g of methacrylic acid, 165 g of tert-dodecyl mercaptan, and 42.5 liters of deaerated pure water in a 100-liter glass-lined reactor equipped with three sweptback blades, a baffle, a cooling pipe, and a temperature sensor, stirring at 70° C. while supplying nitrogen gas), added an aqueous solution of polymerization initiator (prepared by dissolving 205 g of potassium persulfate in 10 liters of pure water) to this mixture, continued polymerization-at 70° C. for 6 hours, and cooled the solution down to room temperature. The resulting product was named "dispersion liquid 1."The pH of this liquid is 4.7.

(2) Association Process

The inventors controlled the pH of dispersion liquid 1 (45 liters) to 9 with an aqueous solution of sodium hydroxide, put the neutralized dispersion liquid in a stainless-steel reactor (equipped with anchor blades, a baffle, a cooling pipe, and a temperature sensor), stirred the liquid, added an aqueous solution (prepared by dissolving 8 liters of aqueous solution of potassium chloride (2.7 mols/liters), 7 liters of isopropyl alcohol and 810 g of polyoxyethylene octylphenyl ether (where the average degree of polymerization of ethylene oxide is 10) in 3 liters of pure water) to the liquid while stirring the mixture, heated the mixture (containing associated particles) to 85° C., kept on stirring the mixture for 6 hours, and cooled the liquid down to room temperature. The resulting single-component developer was named "Toner 11." The number median diameter of toner 11 is 4.5 μm.

The inventors added, as external additives, 0.8% by mass of hydrophobic silica (H1303 manufactured by HDK) and 1.0% by mass of hydrophobic titania A whose degree of hydrophobicity is 60% to the obtained toner product (Toner 11), and mixed the mixture by a HENSCHEL MIXER for addition. The inventors obtained a non-magnetic single-component toner. The glass transition temperature of toner 11 is 71° C.

The inventors prepared hydrophobic titania A (whose degree of hydrophobicity is 60%) by stirring titania (STT30 manufactured by Titan Kogyo K. K.) whose average primary particle diameter is 50 nm in a water-based liquid, adding N-hexyltrimethoxy silane (whose solid content is 20% by mass of titania) to the liquid, drying and crumbing the solid component. The inventors measured the degree of hydrophobicity by putting 50 ml of pure water in a 200-ml beaker, adding 0.2 g of a test sample (hydrophobic titania A), stirring the mixture, adding absolute methanol (dried by anhydrous sodium sulfate) to the mixture through a burette while stirring the mixture, and kept on adding absolute methanol until the sample is not visible on the surface of the mixture (until the end point comes). The degree of hydrophobicity of the sample is calculated from the quantity of used methanol by the expression below.

$$\text{Degree of hydrophobicity}=[\text{Quantity of methanol used}/(50+\text{Quantity of methanol used})]\times 100$$

[Evaluation]

(1) Apparatus for Evaluation

The inventors put each of the two-component developer of Toner 1 to Toner 10 in the developing apparatus (see FIG. 2) and mounted the developing apparatus in the image forming apparatus of FIG. 1. Similarly, the inventors put a single-component developer of Toner 11 and mounted the developing apparatus in the image forming apparatus of FIG. 11. The full-color image forming apparatus of FIG. 11 was modified to disable Y, M, and C developing units and run for toner evaluation without these developing units.

For evaluation, we made 3000 printouts continuously using A4-size quality paper (65 g/m$^2$) under the following printing condition (fixing speed and surface temperature of the thermal roller).

Fixing speed: 175 mm/sec (approx. 50 A4-sheets per minute)

Surface temperature of transfer material: 120° C.

(2) Embodiments and Comparative Examples

As shown in Table-2, Embodiments 1 to 15 use combinations of bearing sections of FIG. 4 to FIG. 10 and the above toners. Comparative examples 1 to 4 use combinations of the bearing section of FIG. 13, which has no protrusion and the above toners. In FIG. 10, the length of the protrusion "L" indicates the height of a conical part of the shaft tip.

(3) Items of Evaluation

<Coagulation of Toner Particles>

Immediately after making 3,000 printouts, the inventors took out 20 g of toner left in the developing apparatus, sieved it by a sieve of 45 μm mesh, and counted toner particles (coagulated particles) left unsieved on the sieve. The evaluation criteria are as follows:

A: 0 to less than 5 particles left on the sieve (Excellent)

B: 6 to less than 10 particles left on the sieve (Good)

C: 30 particles or more left on the sieve (Not good)

<Reproduction of Thin Lines>

The inventors printed a thin-line image corresponding to 2-dot line image signals on the first sheet and the 3000th sheet and measured the widths of lines of the printed toner images by Print Evaluation System "RT2000" (YA-MAN L;td.). The inventors set the image forming apparatus to print thin lines of 100 μm wide and evaluated the lines printed out on the first and 3000th sheets by a ×10 magnifying glass. Thin lines printed on the first sheets were all 100 μm wide.

The evaluation criteria are as follows:

A: Line width change of less than 7 μm (Excellent)

B: Line width change of 7 μm or more and less than 15 μm (Good)

C: Line width change of 15 μm or more (Not good)

<Pitch Irregularity>

The inventors checked the white ground of the 3000th printout for unevenness of print density (pitch irregularity).

A: No periodical unevenness of print density (pitch irregularity) detected by a microscope B: No unevenness of pitch irregularity detected by eyes C: Unevenness of pitch irregularity detected by eyes Table 2 lists the result of evaluation.

TABLE 2

| | Structure of shaft and bearing section | Protrusion length L (mm) | Toner No. | Toner coagulation | Thin line reproduction | Pitch irregularity |
|---|---|---|---|---|---|---|
| Embodiment 1 | FIG. 4 | 3.0 | Toner 1 | A | A | B |
| Embodiment 2 | FIG. 4 | 0.5 | Toner 2 | A | A | A |
| Embodiment 3 | FIG. 4 | 1.5 | Toner 3 | A | B | A |
| Embodiment 4 | FIG. 5 | 1.5 | Toner 4 | A | B | B |
| Embodiment 5 | FIG. 5 | 3.0 | Toner 6 | A | B | A |
| Embodiment 6 | FIG. 6 | 3.0 | Toner 7 | A | A | A |
| Embodiment 7 | FIG. 9 | 0.5 | Toner 5 | A | B | B |
| Embodiment 8 | FIG. 6 | 1.0 | Toner 8 | A | B | B |
| Embodiment 9 | FIG. 4 | 2.5 | Toner 9 | A | B | B |
| Embodiment 10 | FIG. 4 | 1.5 | Toner 10 | A | B | B |
| Embodiment 11 | FIG. 4 | 1.5 | Toner 11 | A | A | A |
| Embodiment 12 | FIG. 7 | 1.5 | Toner 11 | A | A | A |
| Embodiment 13 | FIG. 8 | 1.5 | Toner 11 | A | B | B |
| Embodiment 14 | FIG. 9 | 1.5 | Toner 11 | A | A | A |
| Embodiment 15 | FIG. 10 | 5.5 | Toner 11 | B | B | B |
| Comparative example 1 | FIG. 13 | — | Toner 2 | C | C | C |
| Comparative example 2 | FIG. 13 | — | Toner 4 | C | C | C |
| Comparative example 3 | FIG. 13 | — | Toner 7 | C | C | C |
| Comparative example 4 | FIG. 13 | — | Toner 11 | C | C | C |

As seen from Table 2, Embodiments 1 to 15 have excellent thin line reproduction and no pitch irregularity without toner coagulation. Contrarily, Comparative examples 1 to 4 which use a developing apparatus without protrusions do not have the effect that Embodiments 1 to 15 have.

The developing apparatus according to the present invention comprises a developer container for storing a developer which contains toner, a rotary member for stirring and conveying the developer, and bearing members to hold the rotary member in-the developer container, wherein the bearing member is equipped with protrusions on the area which holds the rotary member.

Accordingly, the developing apparatus retains respective rotary members by protrusions which protrude from the bearing member towards the rotary member. This can reduce the sliding area between the bearing member and the rotary member and solve a problem that toner particles are ground in the space between the rotary member and the bearing member. Also this can rotate the rotary members stably so that wearing of the protrusions are protected.

The developing apparatus according to the present invention comprises a developer container for storing a developer which contains toner, a rotary member for stirring and conveying the developer, and bearing members to hold the rotary member in the developer container, wherein the rotary member is equipped with protrusions on the area on which the rotary member is supported by the bearing member.

Accordingly, the developing apparatus retains respective rotary members by protrusions which protrude from the shaft section of the rotary member towards the bearing member. This can reduce the sliding area between the rotary member and the bearing member and solve a problem that toner particles are ground in the space between the rotary member and the bearing member. Also this can rotate the rotary members stably so that wearing of the protrusions are protected.

In the developing apparatus according to the present invention, the toner which constitutes the developer used by the developing apparatus has a glass-transition temperature of 30° C. or more but not exceeding 60° C.

Accordingly, the developing apparatus can prevent fusion-bonding of low-temperature-fixing toner particles by frictional heat even when the glass-transition temperature of the toner is 60° C. or lower. This structure can solve the problems on use of low-temperature-fixing toners and accomplish a target energy-saving fixing.

In the developing apparatus according to the present invention, the toner which constitutes the developer used by the developing apparatus has a number median diameter of 3 μm or more but not exceeding 8 μm.

Accordingly, the developing apparatus can prevent small-diameter toner particles from being ground on the sliding surface between the shaft section of the rotary member and the bearing section and being coagulated in the sliding space even when the number median diameter of the small-diameter toner is 8 μm or less. This structure can solve the problems on use of small-diameter toners and accomplish a high-quality image formation.

What is claimed is:

1. A developing apparatus comprising:

(a) a developer container for storing a developer which contains toner;

(b) a rotary member for stirring and conveying the developer; and (c) a bearing member to hold the rotary member in the developer container, wherein at least one of the bearing member and the rotary member has a plurality of protrusions on a portion of the bearing member which holds the rotary member, or on a portion of the rotary member which is held by the bearing member, and wherein the protrusions space apart and make point contact between the bearing member and the rotary member.

2. The developing apparatus of claim 1, wherein the bearing member has the plurality of protrusions on the portion which holds the rotary member.

3. The developing apparatus of claim 2, wherein the bearing member has the plurality of protrusions on a surface parallel to an axis of the rotary member.

4. The developing apparatus of claim 1, wherein the rotary member has the plurality of protrusions on the portion which is held by the bearing member.

5. The developing apparatus of claim 4, wherein the rotary member has the plurality of protrusions on a surface parallel to an axis of the rotary member.

6. The developing apparatus of claim 1, wherein the bearing member has an end face perpendicular to an axis of the rotary member, and the rotary member has an end face facing the end face of the bearing member, and one of the end face of the bearing member and the end face of the rotary member has a plurality of protrusions.

7. The developing apparatus of claim 1, wherein the bearing member and the rotary member has the plurality of protrusions.

8. The developing apparatus of claim 1, including a toner having a glass-transition temperature in the range of 30° C. to of 60° C.

9. The developing apparatus of claim 8, wherein the toner has a number median diameter in the range of 3 μm to 8 μm.

10. The developing apparatus of claim 1, wherein each of tips of the protrusions of the bearing member and the rotary member is conical.

11. A process cartridge comprising:

a member used for image formation; and the developing apparatus recited in claim 1.

12. The process cartridge of claim 11, wherein the bearing member has the plurality of protrusions on the portion which holds the rotary member.

13. The process cartridge of claim 12, wherein the bearing member has the plurality of protrusions on a surface parallel to an axis of the rotary member.

14. The process cartridge of claim 11, wherein the rotary member has the plurality of protrusions on the portion which is held by the bearing member.

15. The process cartridge of claim 14, wherein the rotary member has the plurality of protrusions on a surface parallel to an axis of the rotary member.

16. The process cartridge of claim 11, wherein the bearing member has an end face perpendicular to an axis of the rotary member, and the rotary member has an end face facing the end face of the bearing member, and one of the end face of the bearing member and the end face of the rotary member has a plurality of protrusions.

17. The process cartridge of claim 11, wherein the member used for image formation comprises at least one of a photoreceptor drum, a charger an imagewise exposure unit, a pre-transfer exposure light source, and a pre-charge exposure unit.

18. An image forming apparatus comprising: the developing apparatus recited in claim 1.

19. A developing apparatus comprising:

(a) a developer container for storing a developer which contains toner;

(b) a rotary member for stirring and conveying the developer; and (c) a bearing member to hold the rotary member in the developer container, wherein at least one of the bearing member and the rotary member has a plurality of protrusions on a portion of the bearing member which holds the rotary member, or on a portion of the rotary member which is held by the bearing member, and wherein the protrusions space apart and make point contact between the bearing member, wherein a length of each of the protrusions is 1 to 10 mm.

20. The developing apparatus of claim 19, wherein the length of each of the protrusions is almost the same as each other.

21. A developing apparatus comprising:

(a) a developer container for storing a developer which contains toner;

(b) a rotary member for stirring and conveying the developer; and (c) a bearing member to hold the rotary member in the developer container, wherein at least one of the bearing member and the rotary member has a plurality of protrusions on a portion of the bearing member which holds the rotary member, or on a portion of the rotary member which is held by the bearing member, and wherein the protrusions space apart and make point contact between the bearing member, wherein the portion of the bearing member or the rotary member having the plurality of protrusions has 5 to 500 protrusions per square inch.

* * * * *